US008141481B2

(12) United States Patent
Forbes

(10) Patent No.: US 8,141,481 B2
(45) Date of Patent: Mar. 27, 2012

(54) COMPACTING BIN

(76) Inventor: Peter Bernt Forbes, Barcelona (ES)

( * ) Notice: Subject to any disclaimer, the term of this patent is extended or adjusted under 35 U.S.C. 154(b) by 275 days.

(21) Appl. No.: 12/384,003

(22) Filed: Mar. 31, 2009

(65) Prior Publication Data

US 2009/0242567 A1 Oct. 1, 2009

(30) Foreign Application Priority Data

Apr. 1, 2008 (GB) ..... 0805955.2

(51) Int. Cl.
*B30B 7/00* (2006.01)

(52) U.S. Cl. ..... 100/233; 100/131; 220/908

(58) Field of Classification Search ..... 100/131, 100/233, 255; 220/495.08, 230, 615, 660, 220/682, 908, 558, 559
See application file for complete search history.

(56) References Cited

U.S. PATENT DOCUMENTS

| | | | | |
|---|---|---|---|---|
| 2,970,533 | A | 2/1961 | Allen | |
| 3,327,621 | A * | 6/1967 | Zysset | 100/125 |
| 3,980,015 | A * | 9/1976 | Woodard | 100/233 |
| 4,212,242 | A * | 7/1980 | Willis | 100/233 |
| 4,703,611 | A * | 11/1987 | Young | 53/529 |
| 5,421,252 | A | 6/1995 | Reichel | |
| 7,267,048 | B2 * | 9/2007 | Masset | 100/116 |
| 7,434,507 | B1 * | 10/2008 | Sherwood et al. | 100/233 |

FOREIGN PATENT DOCUMENTS

| | | |
|---|---|---|
| DE | 2419369 | 11/1975 |
| DE | 10004057 | 8/2001 |
| FR | 1 014 983 | 8/1952 |
| FR | 2 748 997 | 11/1997 |
| GB | 2310995 | 9/1997 |

* cited by examiner

*Primary Examiner* — Jimmy T Nguyen
(74) *Attorney, Agent, or Firm* — Lambert & Associates; Gary E. Lambert; David J. Connaughton, Jr.

(57) ABSTRACT

A bin suitable for mounting within a rigid enclosure, such as a cupboard, includes; a first section, which may be mounted within an enclosure, connected via a hinge to a second section, onto which a cupboard door may be mounted. Contents placed between first section and second section, when in the open position, are then compacted as second section is rotated closed. The invention may include a magnetic closure mechanism that offers a strong retaining force compared to that required to open the bin, and does so in a way that does not affect the external appearance of door mounted upon second section.

13 Claims, 21 Drawing Sheets

COMPACTING BIN

CROSS REFERENCE TO RELATED APPLICATION

This application takes priority from and claims the benefit of United Kingdom Patent Application Serial No. 0805955.2 filed on Apr. 1, 2008.

BACKGROUND OF THE INVENTION

1. Field of the Invention

The present invention relates to a bin that is suitable for being mounted within a rigid enclosure such as a cupboard, and compacts the contents placed within it.

2. Description of the Related Art

Bins mounted within cupboards are well known and are typically used within fitted kitchens to store rubbish. Commercially available types suffer from:

- having small holding capacities
- being mounted in manners that cannot withstand the repeated force applied by the user pushing compactable materials into them
- having opening mechanisms and door catches that are not adequately resistant to contamination
- the door having to be opened by hand which is inconvenient if the users hands are dirty or occupied carrying material to be placed within the bin Many inventions exist for the compaction of materials, particularly refuse, but their complexity, size and operational requirements render the majority of them unsuitable for domestic use, particularly within a cupboard under a worktop:

- complex mechanisms present problems with the cleaning up of materials spilt while filling or compacting the contents of the bin
- compacting using excessive force renders even relatively small bundles of refuse unmanageably heavy
- liquids spray from partially emptied containers Problems associated with bucket type bins include that:

- when filled, they are difficult to empty due to friction between the liner and the sides of the bin, and a vacuum that forms beneath the liner as it is removed
- if the liner has been punctured by the contents or is ruptured during the removal process, liquids leak into the bin and the contents may scatter into the surrounding area
- they are very awkward to wash out after being contaminated, due to their large volume relative to that of the sink they are to be washed in
- many do not provide an adequate means for retaining the bin liner in place and permit it to fall into the bin thus allowing the contents to come into contact with the bin itself
- liner holding devices, if provided, are often difficult to clean and harbour dirt
- they do not cater to refuse being segregated for recycling purposes or if they do, they do not offer the user enough flexibility in terms of allowing the user to decide upon the number of segregations and the volume that each segregation occupies.

Recyclable materials are often transferred in polythene bags from a bin, or storage area in the kitchen, to the recycling collection point; these bags create more waste and having to transfer piles of stored items into a bag to transfer them is a nuisance.

If it is required that food waste is segregated, it may not be disposed of in plastic liners and is usually stored directly in a dedicated vessel on the worktop. This vessel quickly becomes unsightly and unpleasant to clean and is incongruous with the design of a fitted kitchen.

SUMMARY OF THE INVENTION

The object of the invention is to provide a bin for cupboard mounting that is easy to use and provides a degree of compaction.

According to the present invention there is provided a bin suitable for mounting within a rigid enclosure, such as a cupboard, comprising:

- a first section including:
  - a base;
  - two side walls extending upwards from opposite sides of the base;
  - a rear wall connecting the side walls and sloping forwards; and
- a second section comprising:
  - two side walls sized to fit within and adjacent to the side walls of the first section;
  - a front wall connecting the side walls;
  - a hinge connecting the bottom of the front wall, to the base of the first section.

In some embodiments when the bin is mounted within a rigid enclosure such as a cupboard, one or more of the following elements may be substituted:

- the side walls of the enclosure for the side walls of the first section;
- the base of the enclosure for the base of the first section;
- the door to the enclosure for the front wall of the second section.

Preferably the rear wall to the first section has a demountable connection to the side walls that allows the rear wall to be removed quickly and without the use of tools, comprising:

- walls extending inwards from rear edges of the side walls of the first section and configured with a plurality of apertures;
- a series of hooked protrusions extending back from the rear wall of the first section, that engage with the above mentioned apertures.

Preferably a drip tray is included to rest upon the base of the first section.

Preferably the invention includes a plurality of liner holders connected to top edges of the front and rear walls and configured as a series of sections mounted in line such that a user may either fit one liner through all the holders simultaneously, or fit a series of adjacent liners to the individual holders.

Advantageously the invention includes reusable liners specifically for use in conjunction with an inner biodegradable liner, comprising:

- a bag made from a robust, washable, flexible material such as fabric, proportioned to fit outside of and support all round, an inner biodegradable liner, with;
- a strap or flap situated towards the top of the liner at the front, by which it may be attached to the front wall of the second section;
- an opposite strap loop attached to the rear of the bag mouth and proportioned to connect to the rear wall with enough slack to allow the second section to open to the same degree as is allowed by any other liners that are fitted alongside;
- magnetic elements attached around the mouth of the liner and
- a magnetic holder plate, or plurality thereof, comprising:

an upright flat section, using magnetic force to grip the inner biodegradable liner between itself and the magnetic elements and an upper part extending outwards from the top of the upright flat section of the magnetic holder plate, over the top edges of the reusable and inner biodegradable liners and down on the outside of the reusable, liner and thus preventing material from falling between the upper edges of the reusable and inner biodegradable liners.

Importantly the invention includes a safety device to prevent the second section from falling open to the floor, comprising:

a protrusion extending from a side wall of the first section, towards the opposite side wall;

a tab protruding from a side wall of the second section positioned and proportioned such that when the second section is opened to a point that allows a filled liner to be lifted away un-obstructed, the tab and protrusion engage to prevent the second section from opening further.

While one such safety device may be included in the design, the use of a pair of such devices, positioned on opposite sides is preferred in order to ensure safety in the event that one of the devices should fail.

The preferred closure mechanism, which could be used singularly or as a plurality thereof, comprises:

a first magnetic element connected to the first section, upright and positioned towards the front;

a second magnetic element connected to the second section such that when the bin is closed, the mating face of the second magnetic element lies in the same plane as the outer face of the first magnetic element, the connection also allowing the second magnetic element to move within this plane, with one point of the travel aligning both magnetic elements such that they form a magnetic bond.

In the preferred configuration of the bin, mounted within a cupboard with a door, the preferred embodiment for the closure mechanism just described, comprises:

a sliding mechanism connecting the door to the second section and allowing one degree of freedom preferably in a vertical direction in relation to the door being in the closed position;

a catch mechanism comprising:

a first magnetic element connected to and parallel to, the inner face of the door;

a second magnetic element connected to an inner side or top wall of the cupboard, and positioned such that when the door is closed, the mating faces of the first and second magnetic elements align sufficiently to form a magnetic bond; and one or a plurality of springs connected between the door and the second section, to support the door against the force of gravity when at rest.

Preferably the invention includes a protrusion extending from the lower part of the door, which serves as a pedal by which the sliding closure mechanism just described may be operated, rather than using the door handle.

An alternative closure mechanism comprises one or a plurality of:

a magnetic lever mounted upon;

a pivot connected to the front wall of the second section towards the side;

a magnetic element mounted at the front of the first section, positioned such that when the front wall of the second section is in the upright position, the magnetic lever and magnetic element make contact and bond magnetically.

The advantages provided by the invention include that:

the compacting action stops bulky light materials such as packaging from rapidly filling the bin and does so without the user having to push their hand down into the bin. Unlike power assisted compacting devices, the invention:

does not require extra strong (and expensive) disposable bin liners does not produce bundles of refuse that are excessively compacted and thus excessively heavy does not use such force to compact the refuse that liquids are likely to spray from partially emptied containers does not have a complex mechanical compacting mechanism that requires maintenance the invention may be mounted very robustly within a cupboard.

the invention makes efficient use of cupboard space and augments this efficiency by the compacting action upon the contents placed within the bin.

when built into a cupboard, it still allows access to the back of the cupboard via a removable back panel; thus pipework or other services may still be accessed.

when the bin is open, waste from preparing food on the counter-top above may conveniently be scraped directly into the open bin below.

it provides an effective mechanism for holding the sack liner that is simple to operate, robust, easy to clean and may be removed without tools.

opening the door fully allows the liner to be lifted freely from the bin without the user having to strain their back by pulling the liner upwards against the friction or vacuum created in a bucket type bin. The ease of removal of the liner also reduces significantly the danger of rupturing it.

in the event of a sharp object piercing the liner and allowing liquids to leak, the invention provides a drip tray that is easily lifted out and washed in the sink or dishwasher. This drip tray has a series of indentations on the upper horizontal surface such that any liquids that have leaked onto it, do not spread all over the tray and onto other liners if multiple liners are being used.

the closure mechanism does not affect the external appearance of the cupboard door thus making it compatible with any design of kitchen.

the closure mechanism is magnetic in nature allowing the connection to be between flat faces; thus the contact points are easy to clean.

the magnetic catch is inherently robust in that it simply releases if overloaded.

the magnetic catch mechanism requires very little force to release it compared to the force it exerts keeping the door shut against resilient bin contents trying to de-compress the door maybe opened via a pedal thus the user does not need to touch the door handle if their hands are dirty or occupied holding materials to be placed within the bin a configuration of liner holders is provided that allows the bin to be used with one or more liners simultaneously making it suitable to be used for recycling segregation recycling segregations are indicated by magnetic labels which are thus easily re-arranged to suit the current usage of the bin the exact number of liners to be used is not pre-defined and accommodates the changing requirements of the user the volumes occupied by individual liners are not defined when more than one is used at a time; thus allowing disproportionate quantities of different materials to be stored simultaneously re-usable sacks are provided for the collection of recyclable materials, eliminating the necessity for more plastic waste in the form of bin liners a means of storing organic waste is provided, hidden away, off the counter top and offering a cleaner and more convenient manner for handling and disposing of such waste the door position is adjustable in all three planes for alignment with adjacent units, and also for different door weights the door may be adjusted to make it inoperable to a small child

BRIEF DESCRIPTION OF THE DRAWINGS

The invention will now be described solely by way of example and with reference to the accompanying drawings in which.

DETAILED DESCRIPTION OF THE PREFERRED EMBODIMENT

Figure 1:
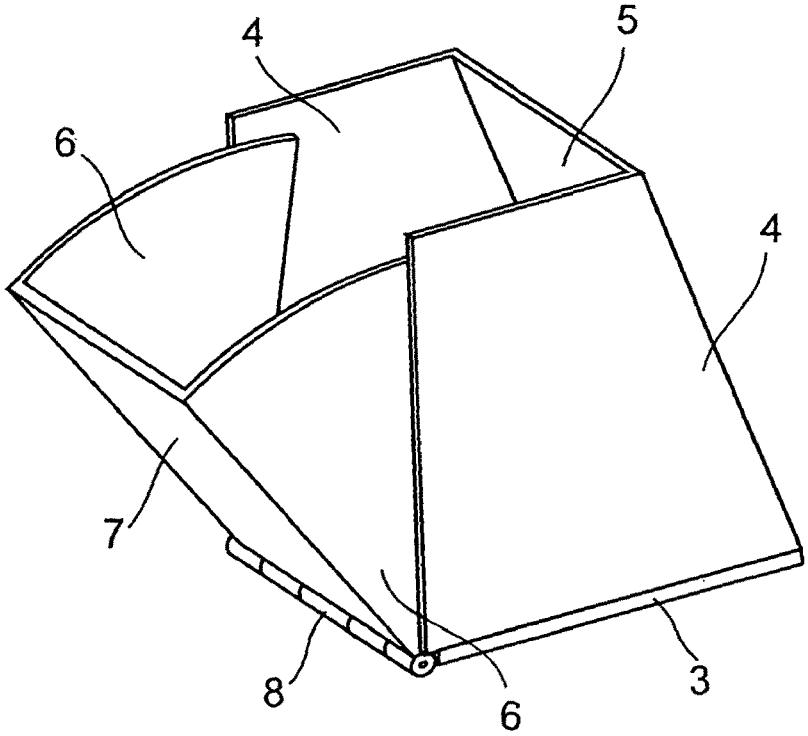
FIG. 1 is a perspective view of a bin according to the invention in the open position.
Figure 2:
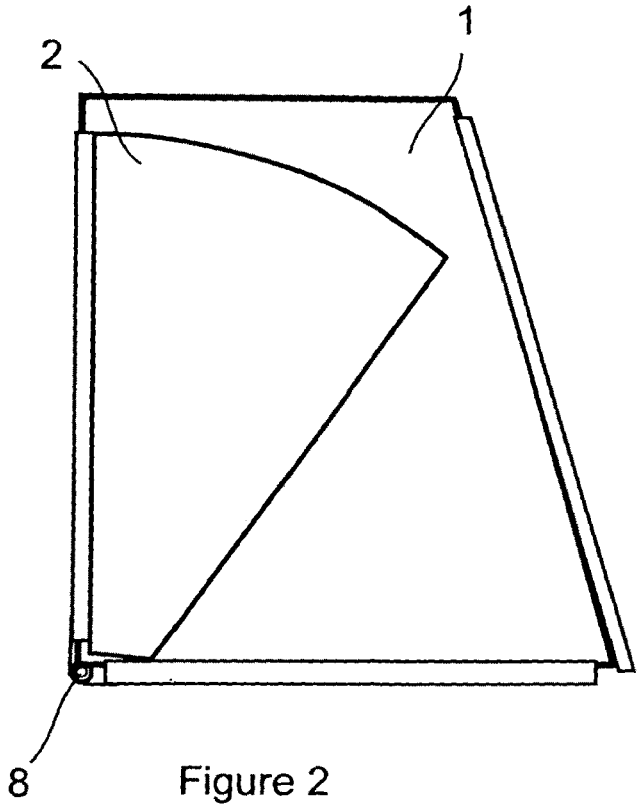
FIG. 2 is a cross-section side view of the bin of FIG. 1 in the closed position.

Referring initially to FIGS. 1 and 2, the bin there shown comprises a base 3 from which two side walls 4 extend upwards on opposite sides. A rear wall 5 joins the two side walls 4, extending up from base 3 and sloping towards the front. The combined parts described so far, form what will henceforth be referred to as the first section 1. This first section 1 is suitable for mounting within a rigid enclosure such as a cupboard.

A second section 2 comprises a front wall 7 and a pair of side walls 6 extending back from the sides of front wall 7. If first section 1 is mounted within an enclosure, the door to the enclosure would ideally be mounted upon the front wall of the second section.

The second section is connected to the first section via a hinge 8 between the lower edge of the front wall 7 and the front edge of base 3. The second section is proportioned to fit within the first section such that when the second section 2 is rotated about hinge 8, side walls 4 and 6, move adjacent to one and other.

FIG. 1 is a perspective view of a bin according to the invention shown in an open position. FIG. 2 is a cross-section side view of the bin of FIG. 1 with the second section 2 rotated within first section 1, about hinge 8, into the closed position.

Figure 3:
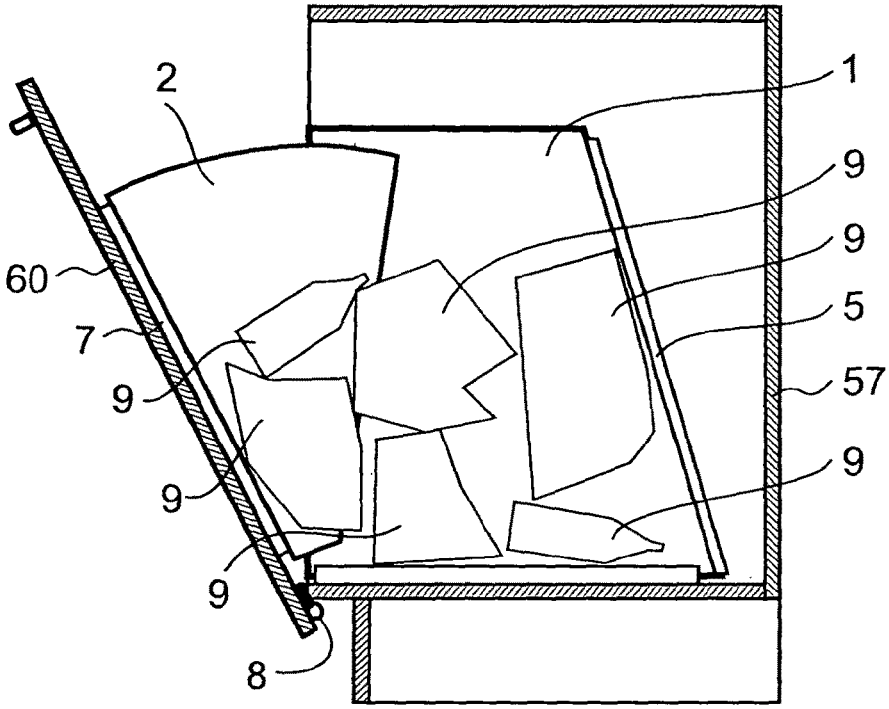
FIG. 3 is a cross-section of the bin of FIG. 2 with contents placed within it, and mounted within a cupboard with a door, in the open position.
Figure 4:
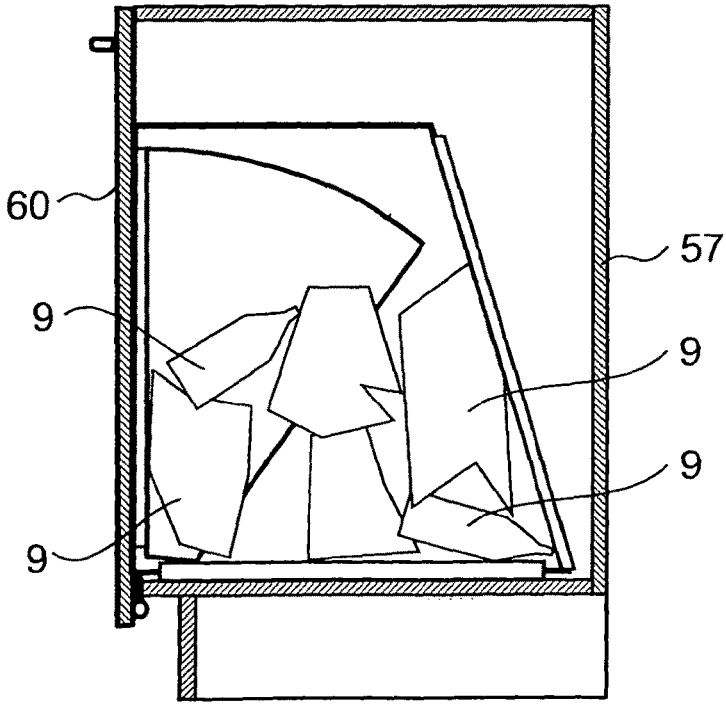
FIG. 4 is a cross-section of the bin of FIG. 3, with the contents compacted by the second section having been rotated closed about hinge 8.

Referring to FIGS. 3 and 4, contents 9 such as refuse, may be placed between first section 1 and second section 2 while second section 2 is in the open position. Contents 9 are then compacted between front wall 7 and rear wall 5 as they are rotated closer together about hinge 8. The slope on rear wall 5 helps to direct contents 9 downwards as they are compacted, rather than allowing them to rise up and spill over the top edges of side walls 4.

FIG. 3 is a cross section view of the bin of FIG. 2 in the open position; first section 1 is now mounted within cupboard 57 and door 60 is mounted upon the front wall 7 of second section 2. Contents 9 have been placed between first section 1 and second section 2. In FIG. 4, the bin of FIG. 3 has been closed and the contents have been compacted.

In this way, the invention provides bin in which the contents are moderately compacted to a similar degree to that achieved by pushing down resilient bulky materials into a bucket type of bin by hand. It does so however, without the user having to make direct contact with the contents or with as much exertion: by pushing the second section from the top, the force applied to contents 9 increases by the principle of bending moments, the closer the objects lie to the level of the pivot; hinge 8.

While a bin according to the invention could be used as a free-standing unit, or be fixed to a floor or wall, it is ideally mounted within a fixed rigid enclosure such as a cupboard with a door. The enclosure makes the bin more aesthetically pleasing and also serves to contain any odours emitting from the bin contents 9. Fixing the bin into position prevents it from moving while force is being exerted upon second section 2 to compact the contents 9.

When sections 1 and 2 are mounted within a rigid enclosure such as a cupboard:

- the walls of the enclosure may be substituted for side walls 4;
- the base of the enclosure may be substituted for the base 3 of first section 1;
- the door to the enclosure may be substituted for the front wall 7 of the second section 2.

In the preferred configuration, mounted within a rigid enclosure such as a cupboard with a door:

- side walls 4 are used in conjunction with the side walls of the cupboard in order to protect the cupboard walls from contamination and wear;
- the base of the enclosure is substituted for the base of first section as the enclosure base is protected by a drip tray later described;
- the enclosure door is used in conjunction with front wall 7 and is mounted onto second section 2 via a sliding mechanism later described.

When the bin is mounted within a rigid enclosure such as a cupboard, preferably the rear wall 5 of the first section 1 is made such that it is demountable and may be quickly removed without the use of tools: this gives convenient access to pipe valves or other services that may lie at the back of the cupboard.

Figure 5:
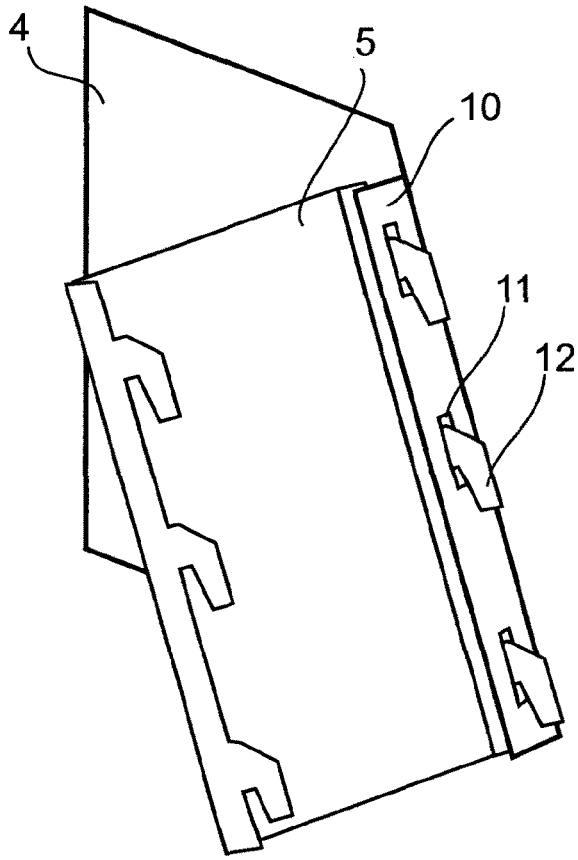
FIG. 5 is a perspective view from behind of a removable rear wall and a side wall into which it fits.

Referring to FIG. 5, an embodiment of a means of connecting rear wall 5 to side walls 4 includes walls 10 extending inwards from the rear edges of the side walls 4 of first section 1. Walls 10 are configured with a plurality of apertures 11. A series of hooked protrusions 12, extend back from rear wall 5 and are configured such that when rear wall 5 is pushed back against walls 10, hooked protrusions 12 pass through apertures 11. Rear wall 5 is then lowered to engage hooked protrusions upon apertures 11 thus lodging rear wall 5 into place.

In this way, when required, rear wall 5 may be simply lifted to disengage the hooked protrusions 12 from apertures 11 and then removed.

FIG. 5 is a perspective view from behind of a rear wall 5 engaging with a side wall 4; hooked protrusions 12 extending from rear wall 5, are engaged with apertures 11.

A first alternative way to fix rear wall 5 to side walls 4, reverses the positions of the hooked protrusions and apertures of the preferred design and comprises one or a plurality of hooked protrusions extending from, or connected to, side walls 4, that engage with one or a plurality of apertures within either rear wall 4, or walls extending from the sides of rear wall 4.

A second alternative way to fix rear wall 5 to side walls 4, while section 1 is mounted within a rigid enclosure, comprises one or a plurality of sliding bolts connected to the rear wall 5 such that when the bolts are extended, they engage with corresponding orifices in side walls 4. To fix the rear wall 5 in place, the sliding bolts are extended to engage within the orifices in side walls 4 and are then retracted when rear wall 5 is to be removed.

Figure 6:
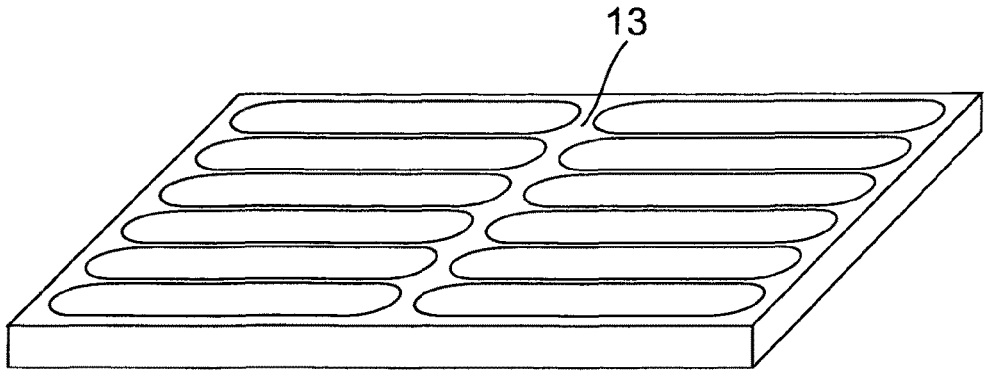
FIG. 6 is a perspective view of a drip tray.

Referring to FIG. 6, a drip tray 13 is provided to rest on the base of first section 1 such that it may catch anything that escapes from a ruptured liner. Such a tray 13 is proportioned such that it is suited to being washed in a sink or dishwasher. While a flat tray constituting a base from which perimeter walls extend upward would suffice as an alternative, the preferred embodiment of a drip tray 13 has a series of hollows on the horizontal surface. The hollows prevent fluids that have leaked onto the drip tray, from spreading across the surface of the tray or accumulating at one end of the tray and spilling if the tray is tipped while being removed from the bin. While any indentations would serve this purpose adequately, in the preferred embodiment the hollows will be rounded without any internal corners as this makes them easier to clean.

FIG. 6 is a perspective view, of such a tray with an array of the preferred rounded hollows on the upper surface.

Preferably the bin includes a one or a plurality of liners to protect the bin from direct contact with the contents 9 and to facilitate subsequent removal of contents 9. The preferred embodiment therefore includes holders by which one may attach one, or a plurality of liners 21 within the volume defined by sections 1 and 2: these holders are connected along the tops of front wall 7 and rear wall 5 and thus the mouths of liners 21 are opened as section 2 is rotated open about hinge 8.

While many clips, pegs and other such devices could serve as liner holders, in the preferred embodiment the liner holders comprise two separate designs: one design for connecting a liner 21 to rear wall 5, and the other for connecting a liner 21 to front wall 7: the ergonomic requirements to install or remove a liner 21 from holders on sections 1 and 2 differ when the bin is installed within an enclosure.

Figure 7:
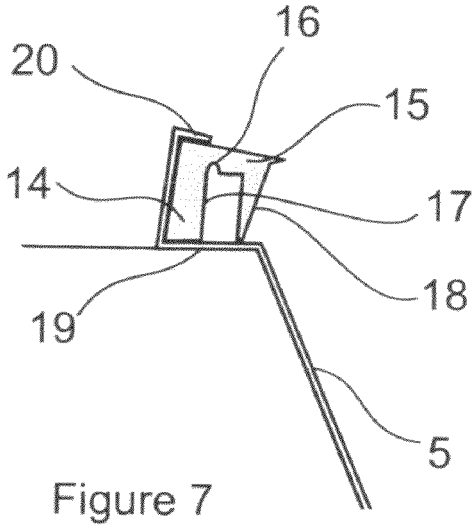
FIG. 7 is a side view of a liner holder mounted upon a modified rear wall of a bin according to the invention.
Figure 8:
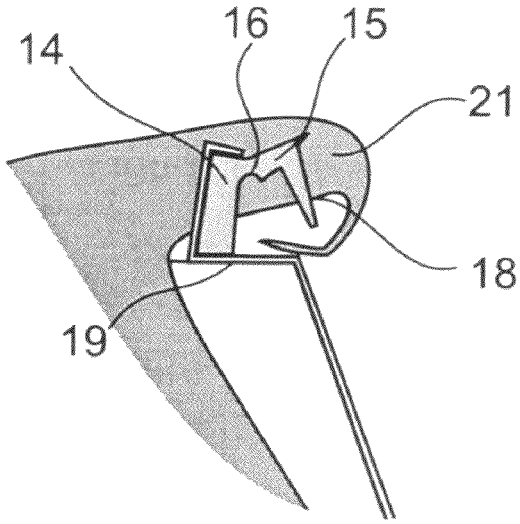
FIG. 8 is a side view of the liner holder of FIG. 7, with a liner being inserted into it.
Figure 9:
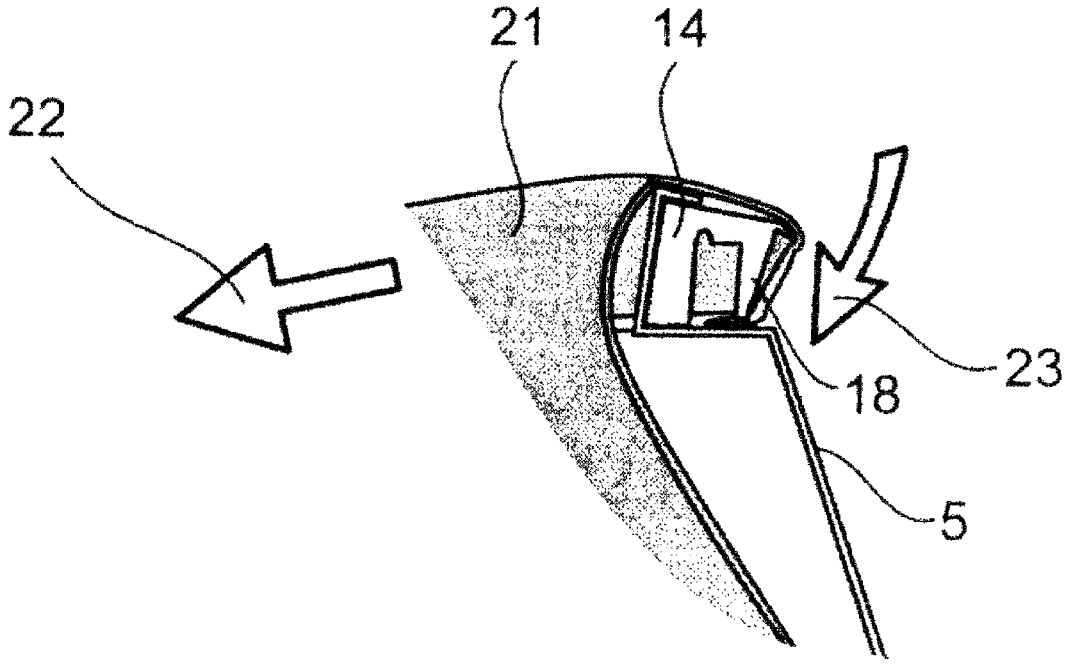
FIG. 9 is a side view of the liner holder of FIG. 7, with a liner inserted and with illustration of how forces act upon it when the bin is opened.

Referring to FIGS. 7, 8 and 9: a first liner holder, ergonomically suited for use on section 1 and henceforth referred to as rear holder 14, is made from a resilient material such as rubber. Rear holder 14 comprises a top section 15, declining towards the rear. A front wall 17 extends downwards from the front edge of the top section. Just behind front wall 17, there is a channel 16 along the underside of the top section, which by making the top section thinner, provides a point at which the top section flexes like a sprung hinge. A second upright wall 18 extends downwards from the top section behind channel 16.

To grip a liner 21 using rear holder 14, liner 21 is wrapped over the top of holder 14, around to the rear and is then inserted under upright wall 18 by lifting upright wall 18 using the mobility permitted by the thinned top section above channel 16.

To hold rear holders 14 in place, the top of rear wall 5 includes a series of tabs which first of all extend forwards from the top edge of rear wall 5, forming a base 19, then an upright section with a backward incline and ending with a declining section 20 extending backwards to the same depth as front wall 17. The rear holder 14 is held by inserting the front of it's top section beneath the declining section 20, and then pushing the front wall 17 against the upright section between base 19 and declining section 20. The resilience of front wall 17 keeps it lodged at rest between base 19 and declining section 20 as to remove it involves further compressing front wall 17, to fit through the narrowest point between base 19 and the lower edge of declining section 20. This method of installation allows the liner holders to be removed and re-installed without the use of tools in order to facilitate cleaning.

The invention allows liner 21 to be installed easily when the bin is mounted within an enclosure; the users lower arm is inserted between the top of the enclosure and the top of the bin holding the liner with the palm of the hand facing downwards. The liner 21 is then inserted into rear holder 14 by simply gripping the liner and wall 18 of the rear holder and making a first, pushing the liner under wall 18 with the fingers in doing so.

Once liner 21 has been installed and the second section 2 is resting open, the weight of the second section 2 is supported by the tension across the mouth of liner 21; this force is transmitted to the rear holder 14. The downward slope on top section 14 deflects this force downwards thus gripping the liner by pinching it between the upright wall 18, and the corner between base 19 the top of rear wall 5.

In FIG. 7, a rear holder 14 is seen from the side, mounted upon a rear wall 5. Front wall 17 is held compressed between top section 20 and base 19 and the upright wall 18 is resting upon base 19.

In FIG. 8, a liner 21 has been wrapped over and behind rear holder 14 and is being inserted under rear wall 18. Top section 15 has distorted about the thinned section above channel 16, as rear wall 18 has been raised, this thinned section acting as a sprung hinge.

FIG. 9 follows on from FIG. 8: the liner 21 has now been installed, the bin is open and the weight of the second section is being supported by the tension in liner 21. The arrow 22 indicates the direction of the tension exerted via liner 21, and the resultant direction of force on the rear holder 14 indicated by arrow 23. The edge of liner 21 may be seen gripped between wall 18 and rear wall 5.

While the first liner holder just described could be used on the opposite to edges of the first and second sections, orientated in opposite directions to face each other, the ergonomic requirements of installing liner into the holders differ due to the opposite orientation. A second liner holder is therefore described here for use on the second section that offers ergonomic advantage.

Figure 10:
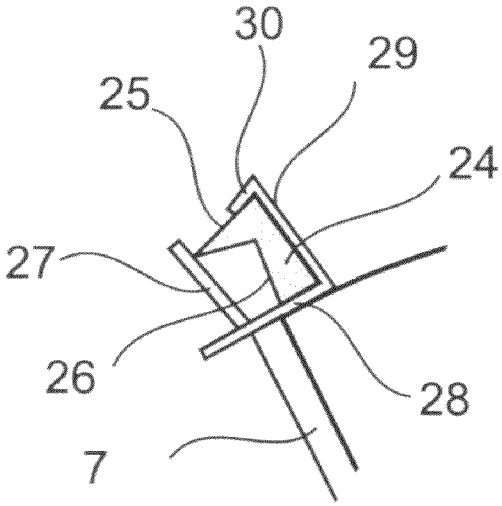
FIG. 10 is a side view of a liner holder for the front of a bin according to the invention.
Figure 11:
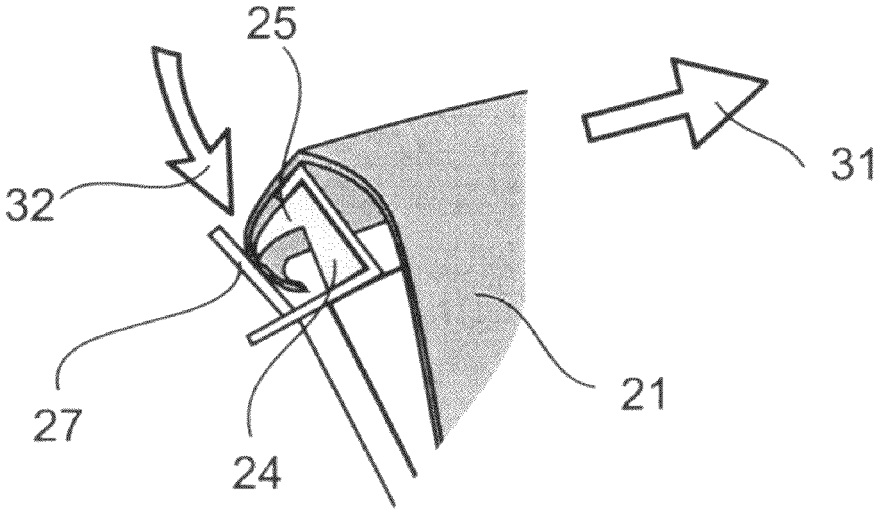
FIG. 11 is a side view of the liner holder of FIG. 10, with a liner inserted and with illustration of how forces act upon it when the bin is opened.

Referring to FIGS. 10 and 11: a second liner holder, ergonomically suited to being used for second section 2 and henceforth referred to as front holder 24, is made from a resilient material such as rubber. Front holder 24 comprises a top section 25 tapering and declining towards the front edge, and an upright wall 26 extending downwards from the thicker end of top section 25.

To hold front holders 24 in place, the top of front wall 5 includes a series of tabs which mirror the form of the tabs used to hold the rear holders 14 and comprise: a base 28 extending backwards from the top edge of front wall 7, leading to an upright section 29 with a forward incline, and ending with a declining section 30 extending forwards. Front holder 24 is held, by inserting the top of upright wall 26 under declining section 30, and then pushing upright wall 26 back against upright section 29. The resilience of upright wall 26 keeps it lodged at rest between base 28 and declining section 30 as to remove it involves further compressing upright wall 26, to fit through the narrowest point between base 28 and the lower edge of declining section 30.

An inclined strip 27 is connected to the second section 2, with the lower edge lying parallel to front wall 7, and with the rear face of the strip resting against the tapered edge of top section 25. A liner 21 is installed by draping it over front holder 24 and then running a thumb or finger along between the tapered edge of top section 25, and inclined strip 27, to lodge the liner between the two. The resilience in the front holder 24 keeps liner 21 pinched between the front holder 24 and inclined strip 27. Once second section 2 is opened and at rest, it's weight is supported by the tension in the liner 21. The resulting force exerted through the mouth of liner 21, is directed downwards by the declining face of the top section 22 against the inclined strip 27. Meanwhile the tapered edge of top section 22 distorts to the shape of the liner thus increasing its grip upon liner 21.

FIG. 10 is a close up view from the side of a front holder 24 being held in position by sections 28, 29 and 30 connected to the top of front wall 7. Inclined strip 27 is resting against the tapered edge of the top wall 25. FIG. 11 is the same as FIG. 10 with the addition of a liner 21 inserted onto front holder 24. The second section 2 is open and a rest as described in the previous paragraph, supported by the tension in liner 21. Arrow 31 indicates the direction of the force exerted via the liner 21 upon holder 24. The resultant direction of the force, as it is deflected by top wall 25, is indicated by arrow 32. The tapered edge of top section 25 is shown distorted by the force and thus it grips liner 21 better both as it is pressed into inclined strip 27, and as the distortion has increased it's contact area with liner 21.

Figure 12:
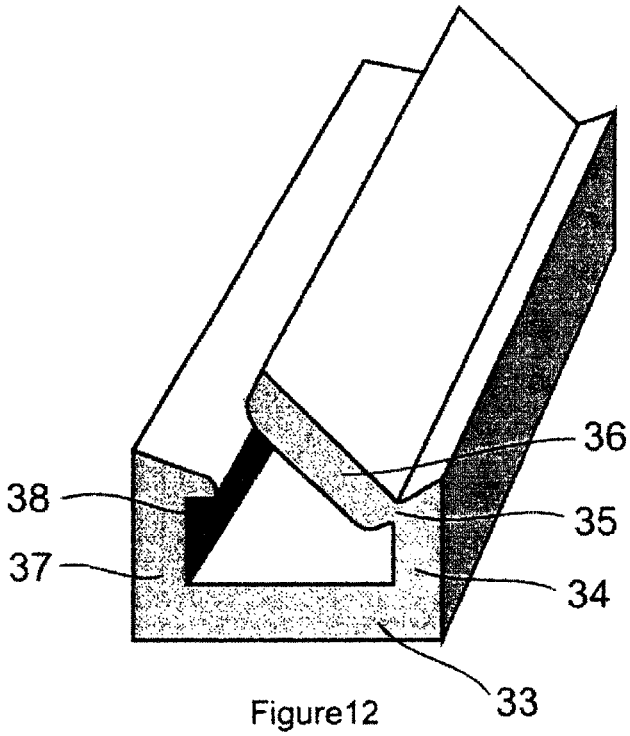
FIG. 12 is a perspective view of a first alternative liner holder.
Figure 13:
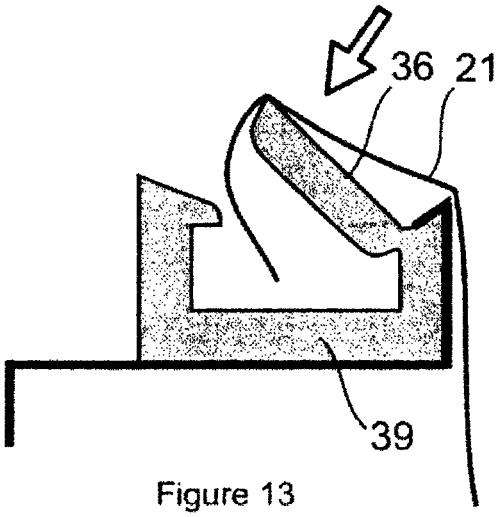
FIG. 13 is a side view of the liner holder of FIG. 12, with a liner inserted into it but not locked into position.
Figure 14:
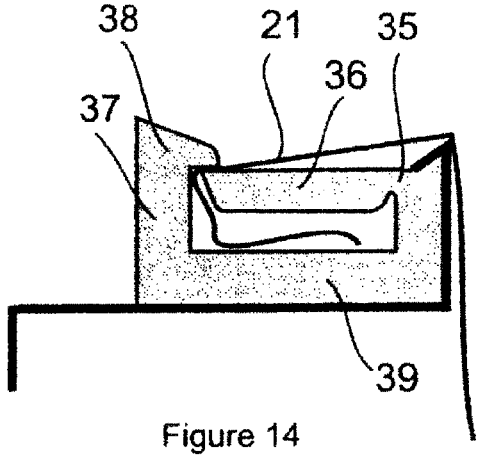
FIG. 14 is a side view of the liner holder of FIG. 13, with the liner locked into position

In this way, the invention provides a means of holding liners that:

- are very robust with respect to contamination
- does not have parts that are separated from the bin during use; which would render them likely to be lost
- are ergonomically designed to be comfortable to use
- may be removed for cleaning without the use of tools Referring to FIGS. 12, 13 and 14, a first alternative to the liner holders described above comprises one designed to fit onto both the front wall 7 and rear wall 5, and includes a base 33 from which a wall 34 extends upwards at one end. The top of wall 34 is connected via a sprung hinge, to an inclined section 36 extending upwards towards the opposite end of base 33. A sprung hinge assembly connects the opposite end of the base plate to a second wall 37 extending upwards. An overhang extends from the top of wall 37 towards the opposite end of the base. The elements of the holder are proportioned such that the inclined section 36 may be pressed down to latch under the overhang using the mobility of the sprung hinges.

This alternative liner holder may be constructed from individual elements but ideally is formed from one continuous piece of resilient material such as rubber whereby the sprung hinges mentioned, may be formed as thinned wall sections using the resilience of the material to act as the hinge and spring simultaneously. Using one continuous piece of material is more robust with respect to contamination than a device consisting of connected components.

FIG. 12 is a view from above and to one side of an alternative liner holder 39 just described, comprising elements 33 to 38 inclusively, made from one continuous piece of resilient material such as rubber. A sprung hinge 35 has effectively been formed by a thinned section of the profile, and the resilience of upright wall 37 is being used as the spring hinge described as connecting the base 33 and wall 37.

FIG. 13 is a profile view from the side of the liner holder 39 shown in FIG. 12, with a section through liner 21. Liner 21 has been wrapped around the inclined section 36 and is ready to be locked into place by being pushed in the direction shown by the arrow. FIG. 14 is the same view as FIG. 13 but now in the locked position: inclined section 36 has been rotated about the sprung hinge section 35, and the flexibility in upright wall 37 has allowed it to lock under overhang 38.

Figure 15:
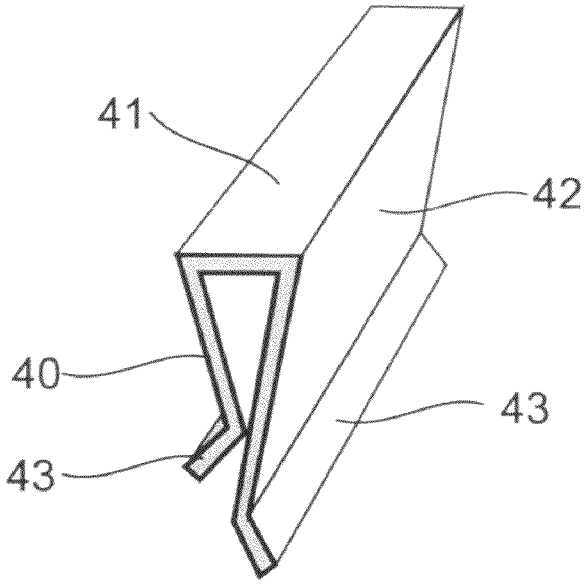
FIG. 15 is a perspective view of a second alternative liner holder.
Figure 16:
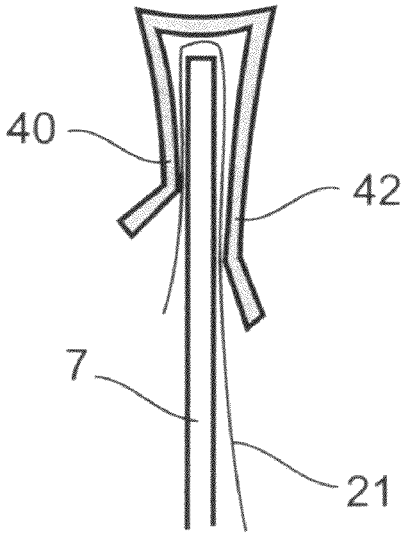
FIG. 16 is a side view of the liner holder of FIG. 15, with it gripping a liner around an edge of a front or rear wall.

Referring to FIGS. 15 and 16, a second alternative design of a liner holder comprises: a middle section 41; converging inclined walls 40 and 42 extend downwards from opposite sides of middle section 41; short inclined walls 43 extend outwards from the bottom edges of both of the inclined walls 40 and 42. An embodiment is constructed from a resilient material such as plastic and is proportioned so that the lower edges of inclined walls 40 and 42 either touch together or one lower edge rests on the inclined wall opposite if walls 40 and 42 are of different lengths. To attach a liner 21 to the top of front wall 7 or rear wall 5, the liner 21 is placed over the top edge the wall and then the design comprising sections 40 to 43, is pressed down on top, the resilience of sections 40 to 42 allowing the lower edges of inclined walls 40 and 42 to move apart and press against the opposite faces of walls 5 or 7. The short inclined walls 43 serve as guides to help the top edge of walls 5 or 7 to slide between inclined walls 40 and 42 rather than colliding with an edge on the holder.

This second alternative liner holder has just been described orientated in an upright position, but it may be used equally in an included or horizontal position.

FIG. 15 is a perspective view from above of a liner holder according to this second alternative design. By example of how the holder of FIG. 15 is used, FIG. 16 shows a section view from the side of the top of front wall 7; liner 21 has been wrapped over the top edge and the liner holder described has been pressed down into place. The flexibility of the material has allowed lower edges of inclined walls 40 and 42 to splay out and pass on either side of front wall; the resilience of the material causes these lower edges to exert a force inwards gripping the liner against front wall 7.

Referring to FIGS. 17 to 20, while the various liner holders described above could be configured as continuous sections along the tops of front wall 7 and rear wall 5, this would only allow one liner to be held at a time. To accommodate segregation of refuse for recycling purposes, the preferred embodiment includes arrays of shorter holders arranged side by side as this allows a series of liners to be held simultaneously.

An ideal length of liner holder is approximately 100 mm wide as this corresponds well to accommodating commercially available bin liners of:

30 liter capacity held by one holder on first section 1 and one holder on second section 2

50 liter capacity liners held by two holders simultaneously on first section 1 and two holders on second section 2

100 liter capacity held by three holders simultaneously on first section 1 and three holders on second section 2

The 100 mm length of holder also tessellates well if a range of bins are to be offered mounted within kitchen units as kitchen units are commonly offered in a range of widths with increments of 100 mm.

Figure 17:
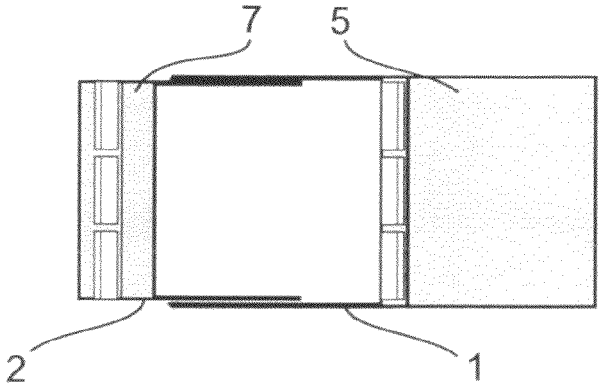
FIG. 17 is a view from above of a bin according to the invention, in the open position and fitted with three pairs of the preferred liner holders

FIG. 17 is a view from above of a bin according to the invention, proportioned to fit within a kitchen unit 400 mm wide and is consequently fitted with series of three liner holders along the tops of front wall 7 and rear wall 5.

Figure 18:
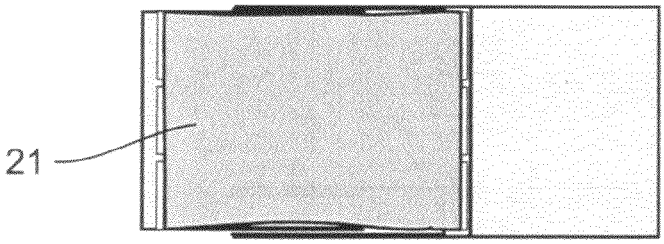
FIG. 18 is the same view as FIG. 17 but with one liner fitted.

FIG. 18 is the same view as FIG. 17 but with one liner 21 fitted through all three holders on each wall.

Figure 19:
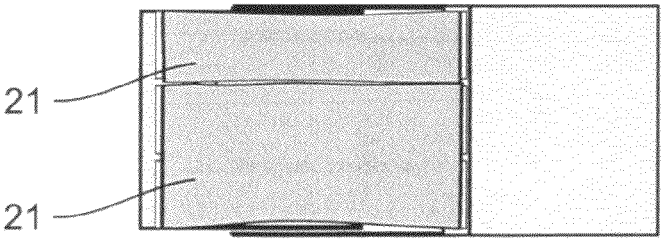
FIG. 19 is the same view as FIG. 17 but with two liners fitted.

FIG. 19 is the same view as FIG. 17 but with two liners fitted: one larger liner (50 liter for example) through two holders on each wall simultaneously, and one smaller liner (30 liter for example) through the remaining holder on each wall.

Figure 20:
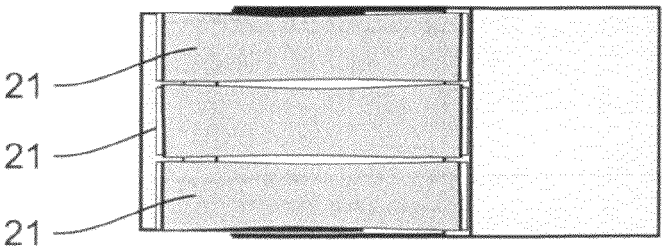
FIG. 20 is the same view as FIG. 17 but with three liners fitted.

FIG. 20 is the same view as FIG. 17 but with three liners 21 fitted to the individual holders.

Figure 21:
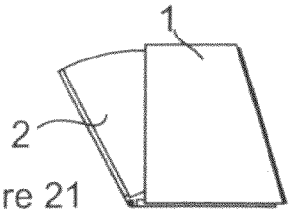
FIG. 21 is a view from the side of the bin the bin of FIG. 17 and illustrates the relative positions of the first and second sections in FIGS. 17 to 20.

FIG. 21 gives a side view of a bin in the open position used for FIGS. 17 to 20.

In this way, the invention provides the user with the possibility of putting all the contents into one liner, or separating the volume into a number of portions to suit the recycling segregation requirements. The proportion of the overall volume of the bin, beneath the holder, that each liner occupies is not defined; thus the invention conveniently accommodates segregated contents delivered in constantly varying proportions.

When the bin is used as a receptacle for recyclable materials, disposable plastic liners may be used but this creates unnecessary waste in the form of the liner itself. Greater efficiency is achieved using a reusable liner to both hold the recyclable materials within the bin, and once filled, transfer them to the recycling collection point.

Figure 22:
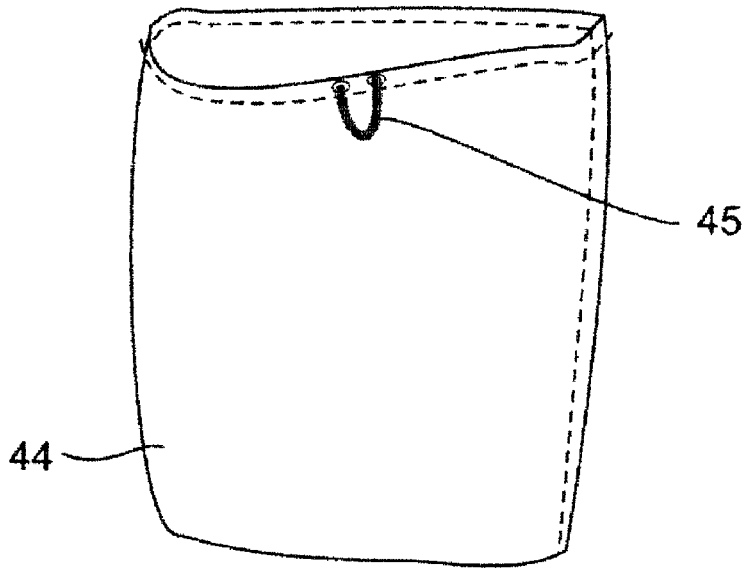
FIG. 22 is a side view of a reusable liner.

Referring to FIG. 22, an embodiment of a reusable liner 44 comprises a bag made from a robust, washable, flexible material, such as fabric, with a drawstring 45 near the top of the liner mouth such that when the liner is removed from the bin, drawstring 45 may be pulled tight and fastened to close the bag mouth and prevent spillage. The reusable liner is installed in the bin in the same manner as plastic liners and described earlier. Ideally the material used will sustain being washed at temperatures high enough to sterilize it and be resistant to corrosive cleaning agents such as bleach.

FIG. 22 is of a preferred embodiment of a re-usable liner 44. Drawstring 45 is seen positioned towards the middle and on the outside of the liner to stop it becoming caught up in the liner holders and soiled by the contents.

Figure 23:
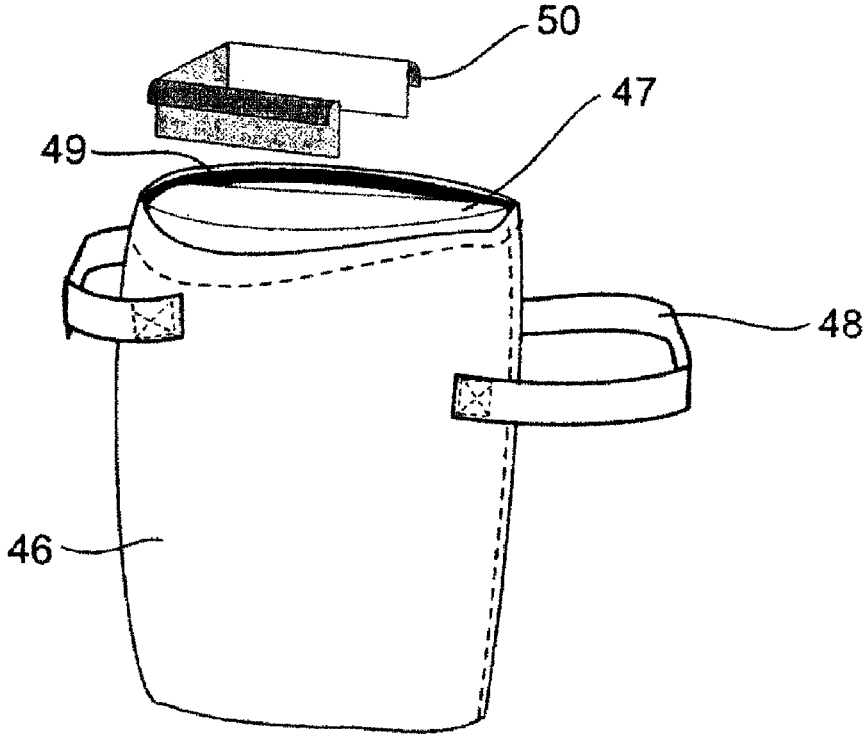
FIG. 23 is a side view of an alternative reusable liner for use with a disposable biodegradable liner seen within it.
Figure 24:
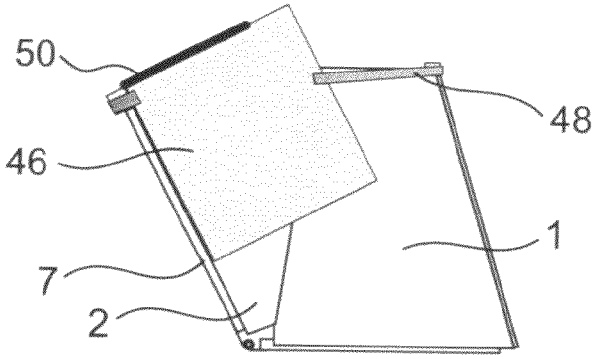
FIG. 24 is cross sectional side view of the bin in the open position with the reusable liner of FIG. 23 installed.
Figure 25:
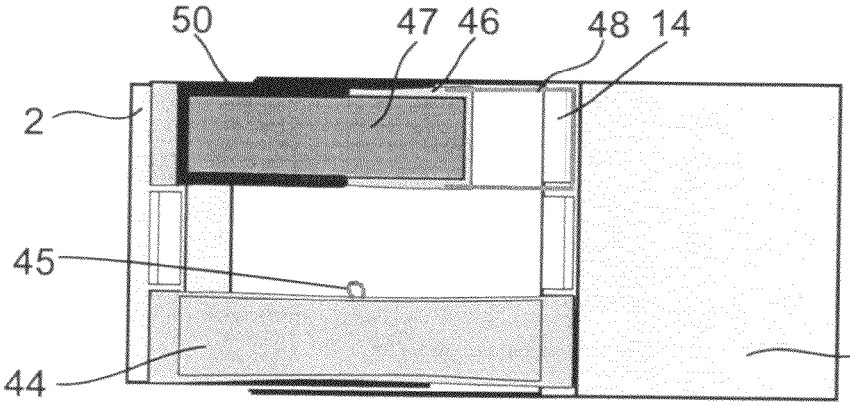
FIG. 25 is the bin of FIG. 17, seen from the same viewpoint, with one of each of the reusable liners of FIGS. 22 and 23 installed.

Referring to FIGS. 23, 24 and 25, the invention includes a reusable liner 46 specifically for holding an inner biodegradable liner 47 for storing organic waste. Organic waste liners are commonly available and are usually made from biodegradable materials such as paper or starch-based plastics. Being designed to decompose rapidly, biodegradable liners become weakened once moistened and if not changed for a few days, are liable to rupture on being removed from a bin. To overcome this, the invention includes a reusable liner 46 proportioned to support a biodegradable liner 47.

Re-usable liner 46 comprises a bag made from a robust, washable, flexible material such as fabric, proportioned to fit outside of and support all around, an inner biodegradable liner 47. An inverted pocket or strap loop connects the front of liner 46 to the front wall 7 of second section 2. An extended rear strap loop 48 attaches the rear of liner 46 to rear wall 5 of the first section 1, and is proportioned with enough slack to allow the sections 1 and 2 to open to the same degree as is allowed by any other liners that are fitted alongside.

Magnetic elements are attached around the top edge of the mouth of reusable liner 46. One or a plurality of upright magnetic plates 50, are placed within the inner biodegradable liner 47 and magnetically press biodegradable liner 47 against magnetic elements 49.

A section extending outwards and then downwards from the top of magnetic plate 50, covers the upper edges of reusable liner 46 and biodegradable liner 47, preventing material from falling between the two and also stopping magnetic plate 50 from sliding downwards.

When inner biodegradable liner 47 is made from a stiff material such as thick paper and is configured to be square or rectangular when seen from the side, it is advantageous to attach rear strap loop 48 to reusable liner 46 at a distance below the top of the liner. The distance from the top of reusable liner 46 should be such that when the liner is pulled taught when mounted within the open bin, the top of reusable liner 46 and front wall 7 of second section 2, rest perpendicular to each other. This is of benefit when the inner biodegradable liner 47 is made from a stiff grade of paper that, if not held square in this way, is prone to distort and fold inwards thus closing the mouth of inner biodegradable liner 47.

FIG. 23 is of a preferred embodiment of a reusable liner 46 for carrying a biodegradable liner 47. Reusable liner 46 is proportioned to support the biodegradable liner 47 on all sides. Rear strap 48 is proportioned to give reusable liner 46 the same effective perimeter as other reusable liners 44 such that when liner 46 is mounted alongside liners 44, they are all pulled taut simultaneously by the opening of the bin. Biodegradable liner 47 has been placed within reusable liner 46. Magnetic elements 49 are in the form of a magnetic strip in this embodiment, which is visible at the top of the inside lip of liner 46. Magnetic plate 50 in this case has been configured as three plates joined together to form three sides of a rectangle: this is ready to be lowered into position whereby biodegradable liner 47 will be gripped between magnetic element 49 (magnetic strip) and the upright walls of magnetic plates 50. Rear strap 48 is attached to reusable liner 46 a distance below the top, the function of this is illustrated in FIG. 24.

FIG. 24 shows the reusable liner 46 of FIG. 23 seen from the side and mounted within a bin in an open position. Rear strap 48 is attached to reusable liner 46 at a distance below the top of reusable liner 46 such that with the front and rear straps pulled taut, the top of reusable liner 46 is resting perpendicular to front wall 7 of second section 2.

FIG. 25 is a view from above of both reusable liners 44 and 46 seen in FIGS. 22 and 23, mounted upon sections 1 and 2 of a bin according to the invention in the open position. Both liners are seen pulled taut simultaneously, strap 48 making up for the difference in the perimeters of the two liners. The three-sided magnetic plate 50 shown in FIG. 23 is seen here holding the front portion of the walls of biodegradable liner 47 against the walls of reusable liner 46. In normal use a third liner of either type shown or of disposable plastic, would be fitted to the centre holders, left empty for clarity in this Figure.

In this way the invention provides a means by which both organic and inorganic materials, may be collected separately within the bin, and be conveniently transferred to their collection point without the use of a plastic liner.

Figure 43:
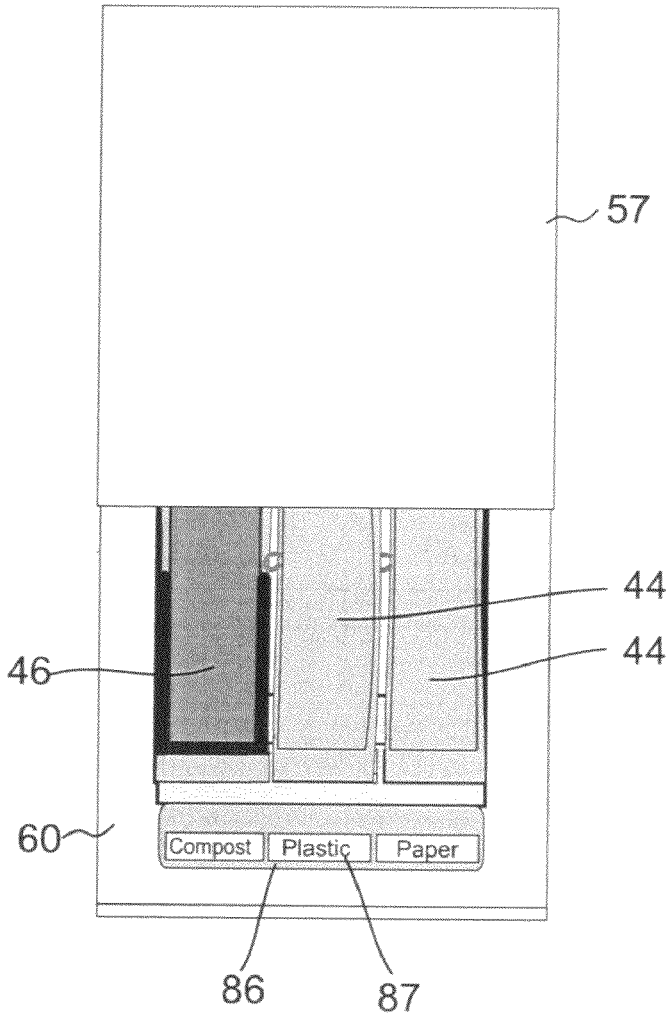
FIG. 43 is a view from above of a bin mounted within a cupboard, with multiple liners whose content type is indicated by magnetic labels.

Referring to FIG. 43, when a plurality of liners are used within the bin for the purpose of recycling segregation, it is useful to label the liners with what type of material is to be placed within them. As the usage may change over time (e.g. more space needed for drinks bottles during summer), a versatile labelling system is used in the preferred embodiment including:

- a magnetic strip 86 mounted upon the door above the liner holders ideally made from a material such as a ferritic or martensitic grade of stainless steel that will not corrode and
- a plurality of magnetic labels 87 identifying the recycling segregations.

In the preferred embodiment of the bin fitted with the front holders 24 described earlier, the lower edge of magnetic strip 86 may also be used to serve as inclined strip 27.

FIG. 43 is of a bin seen from above with door 60 to cupboard 57, in an open position. The bin is fitted with one liner for biodegradable waste 46 and two reusable liners 44. Magnetic labels 87 are attached to magnetic plate 86 positioned above the liners they identify.

Figure 44:
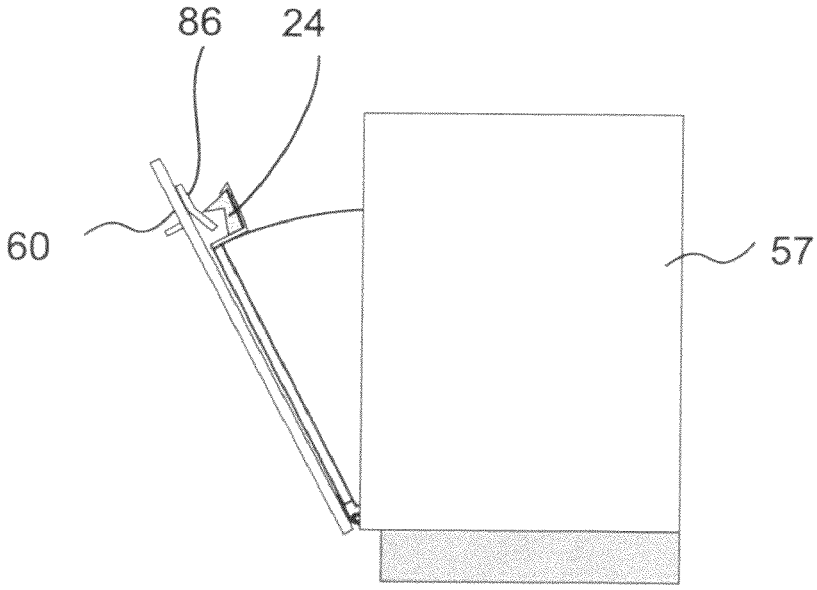
FIG. 44 is the bin of FIG. 43 viewed from the side.

FIG. 44 shows a scaled down view of the bin of FIG. 43 seen from the side to illustrate the relative positions of door 60 and cupboard 57. The liners have been removed to show the side of front holder 24. The lower edge of magnetic strip 86 has been formed to rest against front holder 24.

Figure 26:
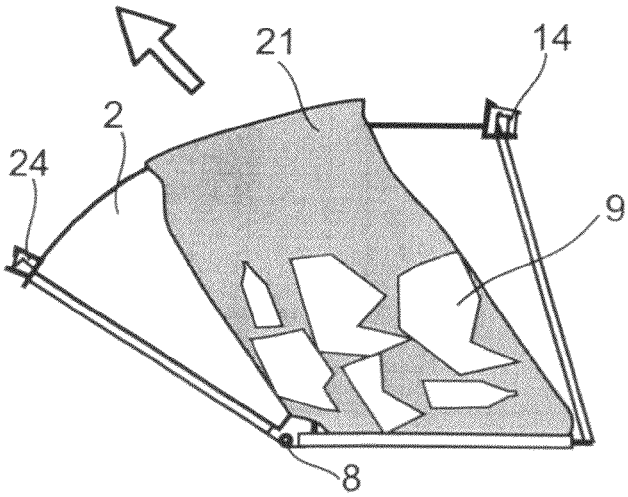
FIG. 26 is a cross-section of a bin according to the invention in a fully opened position ready for emptying; the filled liner has been released from the holders and is now free to be lifted clear from the bin for disposal elsewhere.

Referring to FIG. 26: when one or more liners 21, 44 or 46 and their contents 9 are to be removed from the bin, releasing all liners from the front holders 24, allows section 2 to be rotated open further about hinge 8. Once released from the rear holders 14, the filled liners may then be lifted free without obstacle.

FIG. 26, is a cross-section view from the side of a bin with a liner filled with contents 9 being removed: liner 21 has been released from front liner holder 24, allowing second section 2 to be opened further about hinge 8; liner 21 has also been released from rear liner holder 14 and is now free to be lifted away from the bin in the direction shown by the arrow as the contents are no longer being compacted between first section 1 and second section 2.

Figure 27:
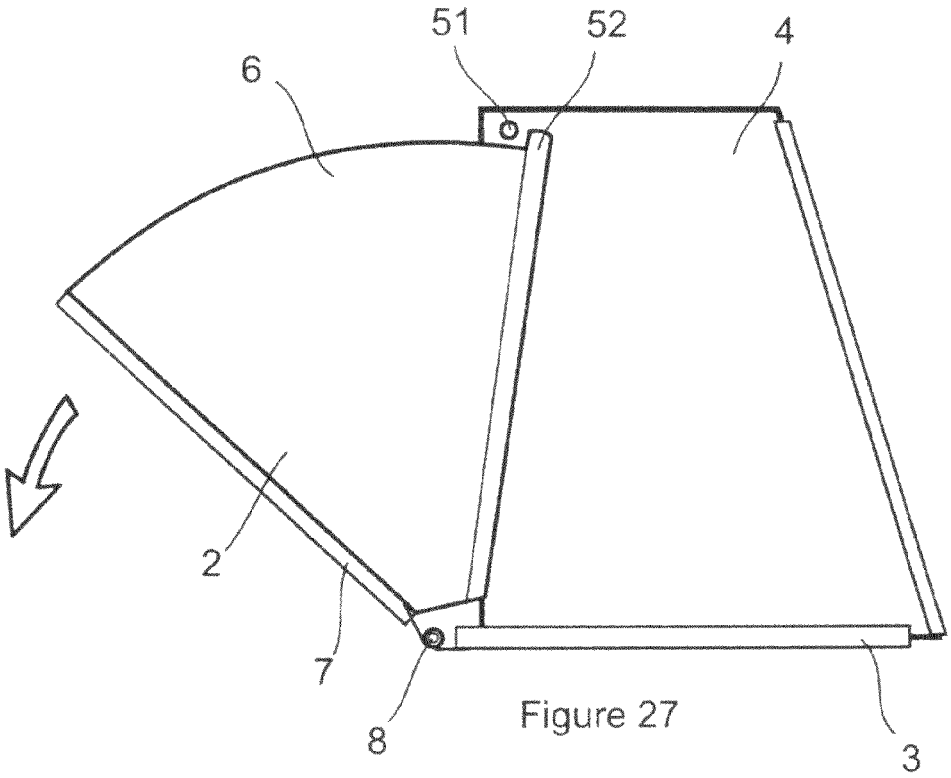
FIG. 27 is a cross-sectional side view of a bin according to the invention, with a safety catch fitted to prevent it from falling open to the floor.

With reference to FIGS. 27, a safety device is included to prevent the second section from falling open to the floor once the liner holders have been released as this could cause injury or damage to the door or handle. Such a safety device comprises a protrusion 51 extending from one or both of the side walls 4 of the first section 1 towards the opposite side wall, and located towards the front of the bin. A tab 52 protrudes from a side wall 6 of section 2, adjacent to the side wall 6 with the protrusion, and is proportioned such that when section 2 is opened to a point slightly whereby installed liners (21, 44 or 49) are no longer compressed and may be easily removed, the tab 52 and protrusion 51 engage to prevent the second section from opening further.

In some alternative configurations, it may be advantageous to include a safety catch that may be released such that the door may be opened to the floor. In this case, to release the catch, side wall 6 is pressed towards the opposite side wall, using the resilience of the material from which it is made, to allow tab 52 to move around protrusion 51.

The rear edge of sidewall 6 extending below and behind tab 52, is angled inwards so that as second section 2 is rotated closed from the fully open position, the angled edge deflects side wall 6 inwards enabling tab 52 to slide over protrusion 51 thus re-setting the catch.

Such a safety device may be used on both side walls 6 but using it just on one side is preferred as in this way, the operator may use one hand to support the second section 2, or door if installed in a cupboard, while using the other hand to release the safety device.

FIG. 27 is a cross-section view from the side of a bin with such a safety device that may be released at a point just before it is about to engage; section 2, comprising front wall 7 and side wall 6, is being rotated open about hinge 8 in the direction shown by the arrow; tab 52 extending from the top of the rear edge of side wall 6, is just are just about to make contact with protrusion 51.

Figure 28:
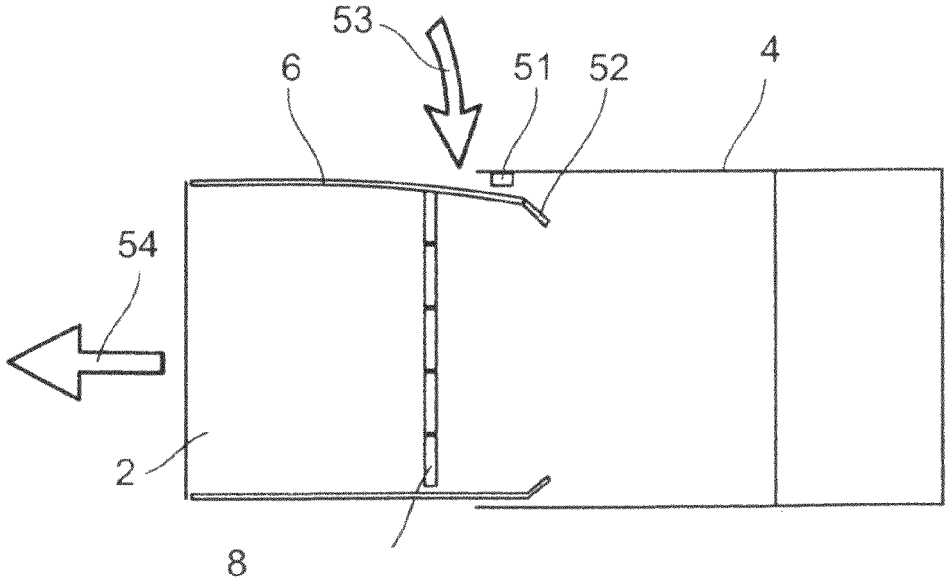
FIG. 28 is a view from above of the bin of FIG. 27 wherein the safety catch is being released.

FIG. 28 is the bin of FIG. 27 viewed from above with the catch being released: side wall 6 is being pushed inwards in the direction shown by arrow 53 to prevent the left hand edge of tab 52 (as seen in this drawing) from striking protrusion 51; second section 2 may then continue to be opened in the direction shown by arrow 54. The angle and size of tab 52, are proportioned such that as second section 2 is closed from the fully open position, the face of tab 52 deflects side wall 6 inwards to allow tab 52 to pass protrusion 51. The catch is thus automatically reset.

The safety catch described above is preferred on the grounds that:

- having no separately moving parts it is very robust with respect to contamination,
- it automatically resets itself,
- it is very simple and economical to construct A first alternative to the above safety device is one in which protrusion 35 is replaced by an indentation and tab 36 is replaced by a protrusion from the side wall 4, placed such that it engages with the indentation at the point at which the travel of the second section is to be restricted. This alternative is less desirable as this protrusion will rub against the side wall 4 of section 1 as the section 2 is rotated about hinge 8, and may thus cause wear and noise as the bin is opened and closed.

A second alternative to safety device described above comprises a flexible element, such as a cord, cable or chain, connected between sections 1 and 2 such that it's length limits the degree of travel of the second section at a desired point. The flexible element is attached in a way that allows one or both ends to be detached such that the bin may be opened fully. This invention is not preferred due to the requirement that the user has to remember to re-attach the flexible element, which is thus fallible.

Figure 29:
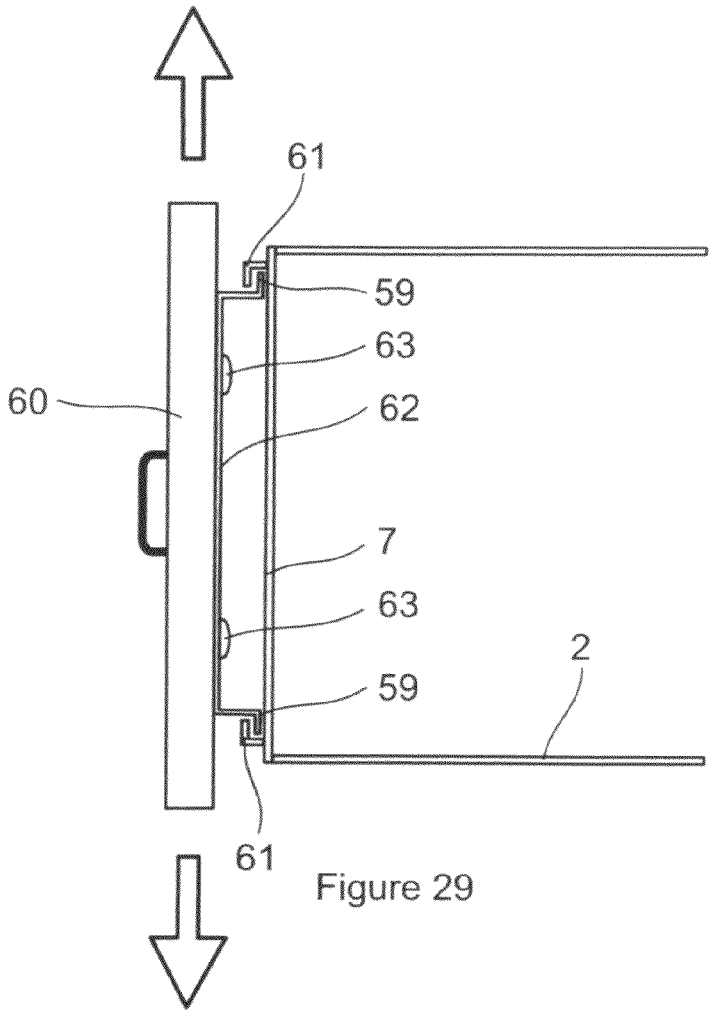
FIG. 29 is a view from above of the second section of the bin, with a door fitted onto it via a sliding mechanism.
Figure 30:
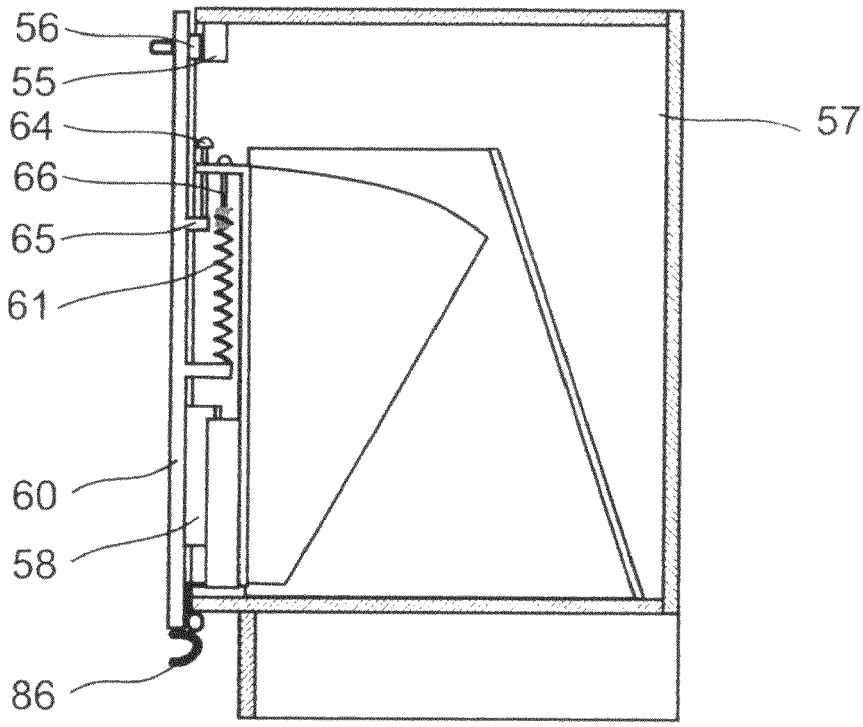
FIG. 30 is a cross-sectional view of the side of the bin of FIG. 4 mounted within a cupboard.
Figure 31:
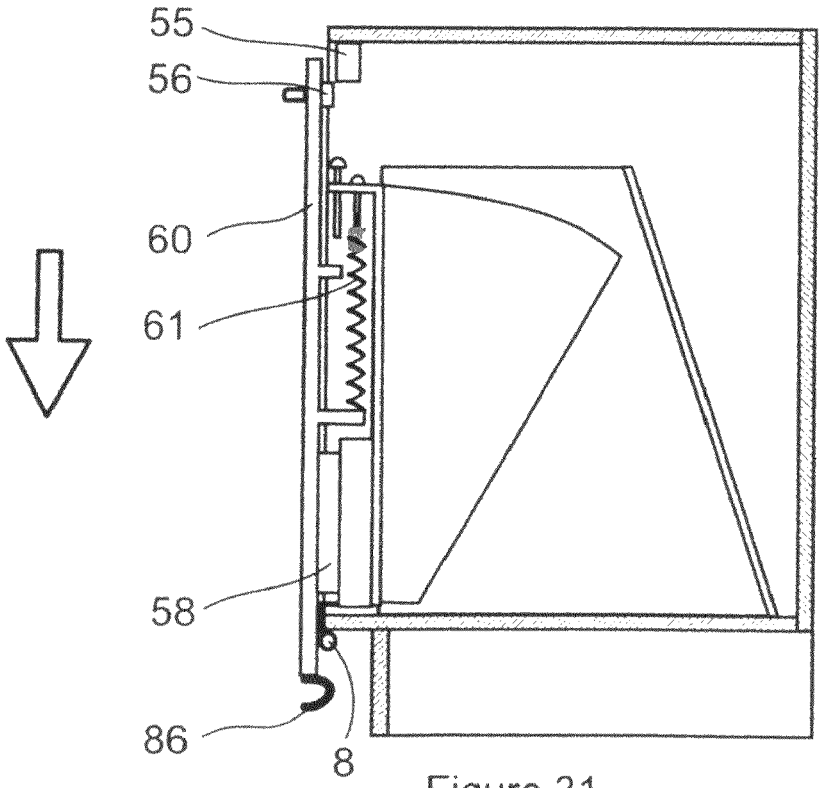
FIG. 31 is the same view as FIG. 30 but with the door depressed in the direction shown by the arrow.

The invention requires a closure mechanism to maintain the second section in the closed position against the de-compressing forces of resilient contents placed within the bin. Many such mechanisms exist for the closure of doors of buildings and cupboards and some of these could be used with or without modification to their means of operation. The preferred closure mechanism however, is of the magnetic type as this allows the connection to be made between a pair of flat faces: flat faces are inherently robust with respect to contamination as they can be cleaned easily. While a catch of this nature could simply comprise a magnet on one section, aligned to connect with a magnetic piece mounted on the other, the forces exerted by the resilience of compacted contents may be quite great and therefore quite a strong magnetic bond is required. Opening the bin by simply pulling it to overcome the magnetic bond would require more force than is desirable for comfortable operation and therefore, the preferred embodiment of the invention therefore includes one or a plurality of the closure mechanisms now described:

With reference to FIGS. 29, 30 and 31; a magnet 55 is connected to first section 1 in an upright position towards the front. A magnetic plate 56 is connected to second section 2 such that when the bin is closed, the mating face of magnetic plate 56 lies in the same plane as the outer face of magnet 55. The connection between second section 2 and magnetic plate 56 allows magnetic plate 56, to move within this plane, with one point of the travel aligning magnetic plate 56 with magnet 55. The magnet 55 and magnetic plate 56 positions could also be reversed to the same effect.

The bin is secured in the closed position when magnet 55 and magnetic plate 56 are aligned thus forming a magnetic bond; the release is achieved by sliding magnetic plate 56 out of alignment with magnet 55 thus breaking the magnetic bond.

Sliding magnets apart in the same plane in which the faces meet, requires very much less force than is required to pull magnets apart in a direction perpendicular to the mating faces. In this way the invention provides a means by which a strong force is provided to retain the bin closed, that requires relatively little force to release it.

With reference to FIGS. 29, 30 and 31; a bin mounted within a cupboard with a closure mechanism of the sliding magnet type mentioned above, comprises:

- A first section 1 mounted within a cupboard and a second section 2 connected to it along the bottom front edge, via hinge 8.
- A door 60 mounted upon front wall 7 via sliding mechanism 58 which allows door 60 to move relative to second section 2, parallel to front wall 7 and side walls 6 i.e. vertically when the door is closed.
- A catch comprising a magnetic plate 56 and a magnet 55. Magnetic plate 56 is connected to and parallel to, the inner face of door 60, and magnet 55 is connected to an inner side or top wall of cupboard 60. Magnetic plate 56 and magnet 55 are positioned such that when door 60 is closed and at rest, the mating faces of magnetic plate 56 and magnet 55 align to form a magnetic bond. Sliding the door, as is permitted by sliding mechanism 58, breaks the alignment of magnet 55 and magnetic plate 56, leaving the door free to rotate open about hinge 8.
- One or a plurality of springs 61 connected between door 60 and second section 2, support the door against the force of gravity when it is at rest in the closed position.
- An first alternative design reverses the mounting positions of magnetic plate 56 and magnet 55
- A second alternative design changes the orientation of the sliding mechanism to cause magnet 55 and magnetic plate 56 to be slid apart in a non-vertical direction.

In the preferred embodiment of the invention, all the following features are also included though in alternative configurations one or more may be excluded:

- a protrusion 86 extending from the lower part of the door serves as a pedal by which the sliding closure mechanism may be operated instead of using the door handle.
- a piston damper extending forwards from a front edge of the cupboard to ensure that magnet 55 and magnetic plate 56 close together gently rather than snapping together noisily.
- a mounting plate 62 connects sliding mechanism 58, to door 60 and permits lateral adjustment of door 60 during installation: mounting plate 62 has a series of slots cut through it, through which screws 63 are used to attach mounting plate 62 to door 60; the slots permit the position of door 60, relative to mounting plate 62, to be adjusted until the screws 63 have been fully tightened. In this way, the lateral position of the door may be adjusted, this being beneficial when it is to be aligned with adjacent units.

FIG. 29 is a view from above, of a second section 2 connected to a door 60 via a sliding mechanism 58, comprising elements 59 and 61, and a mounting plate 62. Right-angled sections 61 are connected to front wall 7 and are holding walls 59, connected to door 60, via mounting plate 62, in such a manner that the only movement possible is perpendicular to the drawing view. The heads of screws 63 are visible as they connect mounting plate 62 onto door 60 through horizontal slots (not visible in this view). Until the screws are fully tightened, the slots allow the lateral position of the door to be adjusted in the directions shown by the arrows.

A means by which the upper limit of travel of door 60 may be adjusted when mounted onto sliding mechanism 58 comprises a screw 64, connected to second section 2, and a protrusion 65 extending from the rear of door 60. The axis of screw 64 is mounted in line with the direction of travel allowed by sliding mechanism 58, and contact between screw 64 and protrusion 65 prevents the door from moving further along sliding mechanism 58 in the direction exerted by spring 61. Turning screw 64 adjusts it's position relative to it's mounting and thus adjusts the resting position of the door.

An alternative design reverses the positions of screw 64 and protrusion 65 to those described in the previous paragraph.

A means by which the tension of spring 61 may be adjusted comprises a screw 66 used to attach one end of spring 61 to either door 60 or second section 2. Screw 66 either threads directly into spring 61 or into spring 61 via a connecting piece. The shank of screw 66 passes freely through an aperture in a mounting connected to either door 60 or second section 2, before engaging with spring 61. Turning screw 66 adjusts the position of the end of spring 61 relative to the mounting and in so doing changes the length and therefore tension of the spring. In this way the invention allows adjustment to the pressure required to push the door downwards, to release the catch. This is beneficial when making adjustment for different weights of door or for making the catch too stiff for a small child to operate.

FIG. 30 is a cross-sectional view from the side of a bin mounted within a cupboard 57. Door 60 is in the closed position with magnet 55 bonding to magnetic plate 56. The tension in spring 61 is pulling door 60 upwards, as is permitted by sliding mechanism 58, to make protrusion 65 rest against the end of height adjustment screw 64.

FIG. 31 is the same view as FIG. 30 but here door 60 has been pushed downwards against the tension in spring 60, as shown by the arrow. Magnet 55 and magnetic plate 56 are no longer aligned and therefore the magnetic bond holding the door closed, has been broken; the door is now free to be rotated open about hinge 8. Pedal 86 is seen mounted upon the bottom edge of the door where it may be used as an alternative to the door handle, to push the door downwards.

Figure 32:
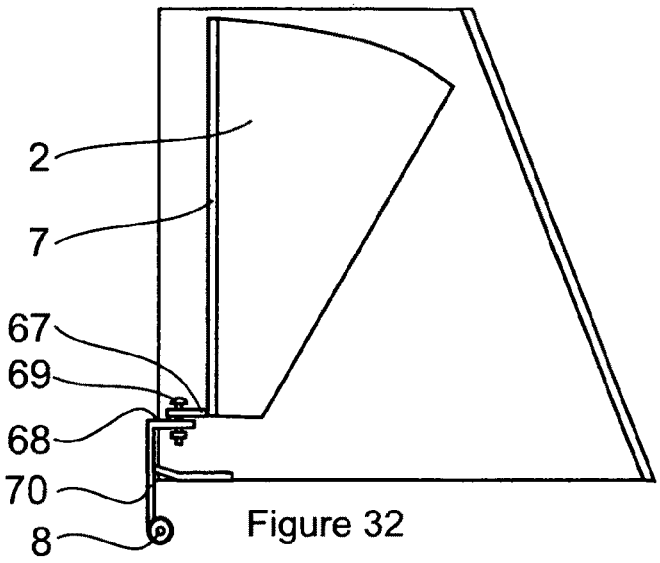
FIG. 32 is a cross-section of the bin of FIG. 3, to which an adjustable connection between the second section and the hinge has been added.

Referring to FIG. 32, an adjustable means of connecting second section 2 to hinge 8 comprises; parallel walls extending from the lower edge of front wall 7 and the top of hinge 8, each fashioned with a series of corresponding apertures. Wall 67 extend forwards from the lower edge of front wall 7, and wall 68 extends back from the top of hinge 8. Both walls 67 and 68 are fashioned with aligning apertures, which in one or both cases comprise slots instead of holes. Fasteners pass through the apertures, connecting front walls 67 and 68, allowing the relative positions of the two walls to be adjusted within the constraints of the apertures until the fasteners are tightened. This aspect of the invention is beneficial when the bin is mounted within a cupboard as in this way, the position of the lower end of door 60, mounted upon second section 2, may be adjusted with respect to the front face of the cupboard: this enables adjustments to be made to align the door with adjacent units, or should the installer wish to fit an airtight sealing strip between the front edge of the cupboard and the door.

FIG. 32 is a cross section view from the side of a bin fitted with a hinge as described in the previous paragraph. Wall 68 is connected to hinge 8 by vertical wall 70 extending from hinge 8. Walls 67 and 68 are connected via fasteners 69 passing through a series of apertures, which are not visible in this view.

Figure 33:
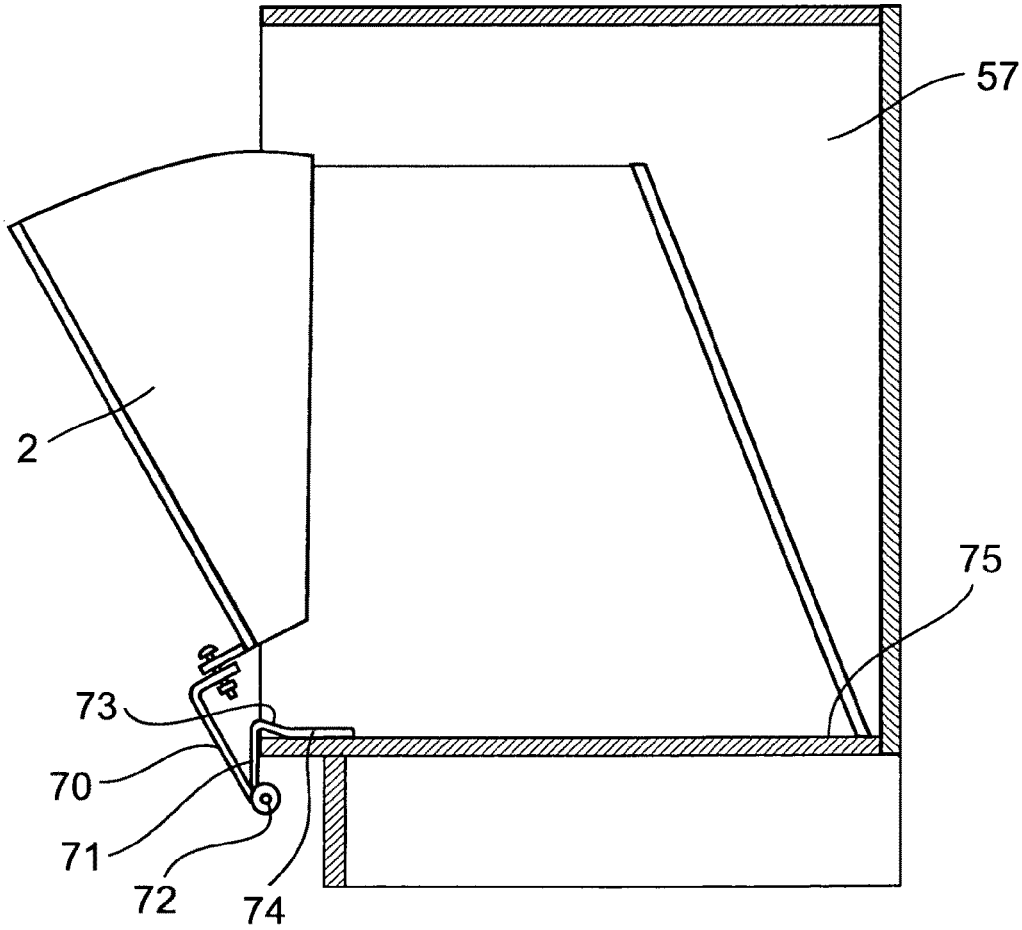
FIG. 33 is a cross-section of the bin of FIG. 32, wherein the part of the hinge connecting with the cupboard has been modified to abut on two faces of the cupboard simultaneously.

Referring to FIG. 33, the invention includes an improved section to hinge 8 for mounting within a cupboard made from a weak material such as low-density particle board, and is suited to being formed from folded sheet metal. The improved section of hinge 8 comprises an upright wall 71, which rests against the front face of cupboard 57, extending upwards from hinge pin 72, to above the height of the base of the cupboard. From the top of wall 71, a sloping wall 73 declines back into cupboard 57 and then continues further back as horizontal section 74, resting on top of base 75 of cupboard 57. Horizontal section 74 has a series of apertures through which fixings may be driven into base 57 to fix hinge 8 into position.

This improved hinge is of benefit when the bin is to be mounted within a cupboard made from low-density particle-board, as is commonly the case with kitchen units, as it allows the hinge fixings to be driven into the face of the cupboard base, rather than the edge which is more prone to splitting. The hinge needs to be made from a material that will not distort with use and is therefore likely to be at least 1.5 mm thick; this design enables the part to be formed by folding a sheet material such as metal where these folds form tightly radiused curves rather than sharp corners. The hinge needs to pivot either on or below the bottom front edge of cupboard base 75 if the door 60 is to open freely without striking the front edge. The front face and the base of the cupboard usually meet with a sharp corner and so by using the preferred lower hinge design, wall 73 may rest flat against the front face of base 57, while wall 74 rests flat against the upper surface: this would otherwise not be possible due to the sharp corner on the cupboard, interfering with the curved intersection between the vertical and horizontal elements of the hinge.

Preferably the hinge 8 is constructed with walls 70 and 71 extending in the same plane from hinge pin 72, so as to form what is commonly known as a 'flush hinge'; this minimises the space occupied by the hinge 8 between the front face of cupboard 57 and door 60.

FIG. 33 is a cross-section view through cupboard 57, from the side, with a bin fitted with a flush hinge as described in the previous three paragraphs. The hinge comprising sections 70 to 74, combines the features of the folded metal type for fitting onto low-density particle-board, and the flush type just described. Second section 2 has been rotated open about hinge pin 72, this revealing the walls 70 and 71 simultaneously as, being of the flush type, they lie in the same plane when section 2 is in the upright closed position. The top of wall 71 extends above base 75 and rests against the front face of cupboard 57. Horizontal section 74 rests upon the upper surface of base 75 and has fixings driven through it in to the base, which are not visible in this view.

Figure 34:
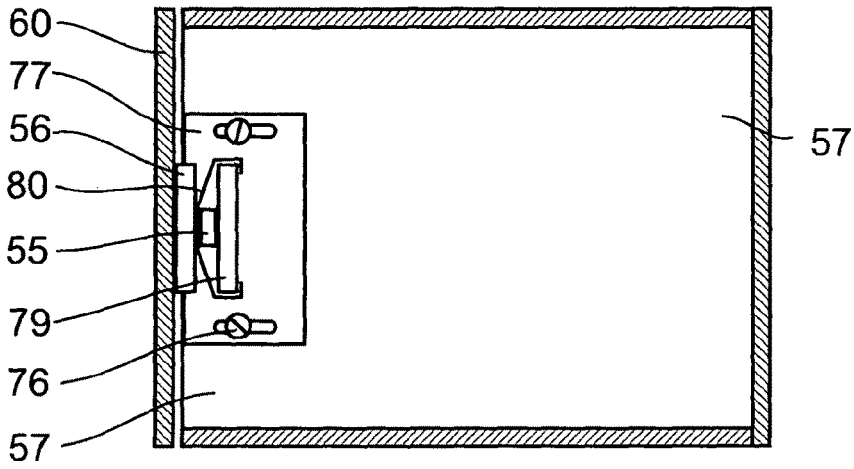
FIG. 34 is a cross-section view from underneath the top of a cupboard and illustrates the preferred way of fixing the magnet assembly into the cupboard when installing the bin of FIG. 30.

Referring to FIG. 34, a means of adjustment of the distance of the top of door 60 in the closed position relative to the front face 78 of cupboard 57, comprises a mounting plate 77 for magnet 55 (or magnetic plate 56 if their positions are reversed as earlier described), with a one or a plurality of slots perpendicular to front face 78. Screws 76 are driven through the slots into the cupboard to secure magnet 55 and mounting plate 77, allowing the positioning to be adjusted until screws 76 are tightened.

To improve the strength of the magnetic bond, the invention preferably includes a magnetic block 79 attached to the opposite face of magnet 55 to that which mates with magnetic plate 56. Magnet 55 may either abut a face of magnetic block 79, or may be recessed into it though if recessed, the sides of magnet 55 must not touch the sides of the recess. Magnetic block should ideally have the same proportions as the magnetic plate 56 of the catch. The configurations just described give a substantial improvement to the flow of magnetic flux and thus substantially strengthen the magnetic bond of the catch.

To make the catch open with a quiet and smooth action, the invention preferably includes a thin cover wall 80 that lies between the mating faces of magnet 55 and magnetic plate 56. Cover wall 80 is relatively thin so as not to adversely affect the magnetic bond too greatly by separating the mating faces too far. Cover wall 80 is made from a tough material with a low coefficient of friction, such as a plastic; examples of suitable materials are nylon and ABS. The purpose of this preferred addition to the design is that it allows the magnetic plate 56 to slide easily over magnet 55 as the catch is opened; this gives a smoothness of operation that is more aesthetically pleasing than if the metal faces of the magnet 55 and magnetic plate 56 make direct contact as metal faces rubbing together have a tendency to grate.

FIG. 34 is a horizontal cross-section, viewed from within the cupboard, of the underside of the top of the cupboard with a magnetic catch arrangement as described in the previous three paragraphs. An assembly, comprising magnet 55, cover wall 80, magnetic block 79 and mounting plate 77, is seen attached to the underside of the top of cupboard 57 via screws 76. Magnetic plate 56 is bonded with magnet 55 through cover wall 80 and as such is holding door 60 in position.

In this way the invention provides a closure mechanism that is ideal for mounting the bin within a cupboard in that:

- it does not require the exterior face of the door 45 to be modified in any way as the mechanism may be released by pushing down on any handle, knob or rebated edge that the door is already provided with,
- the magnetic catch described, is robust both in terms of contamination, and also in terms of being overloaded: any excessive force from within the bin or from pulling it directly open instead of pushing the door downwards in the manner described for releasing the catch, will simply break the magnetic bond rather than any mechanical part,
- it permits adjustment of the door position in all 3 planes and also for different door weights thus rendering it very versatile in installation.

A first alternative closure mechanism is now described referring to FIGS. 35 to 42 inclusively and comprises one or a plurality of the following: a magnetic lever 81 mounted upon a pivot 82 which is connected to front wall 7 of second section 2 and situated towards the side; a magnetic piece 83 mounted at the front of section 1 and positioned such that when front wall 7 is in the upright position, magnetic lever 81 and magnetic piece 83 connect.

While the flat faces of magnetic lever 81 and magnetic piece 83 may be simply pulled apart, the separation is achieved with less force by using the principle of bending moments: provided that pivot 82 is towards the end of magnetic lever 81 where it engages on magnetic piece 83, pulling the opposite end of the lever, pivots it away from magnetic piece 83 thus prising the faces apart with relative ease. The magnetic lever 81 may use the magnetic piece 83 as a fulcrum or a block beside magnetic piece 83. When the lever 81 no longer lies flat against magnetic piece 83, the magnetic flux passing through it is considerably diminished compared to when the faces lay flat against one and other; thus the bond between them is considerably weakened and the bin may be opened. In this way, the invention provides a means by which the bin provides a relatively large force retaining it shut, compared to a much smaller force required to pull it open.

When this alternative design is used within a cupboard, the cupboard door 60 is mounted onto hinge 8, such that it may rotate independently of section 2 and cupboard 57. A spring 84 connects door 60 to section 2 such that they rest together. The rear face of door 60 is connected to the end of one or a plurality of levers 81 such that by pulling the door, spring 84 extends, and the levers are rotated about their pivots 82; the magnetic bond holding the bin closed is thus broken. In this way, a catch mechanism is provided that does not require any modification to the exterior face of the door and may be operated by the same means of handle, knob or rebated edge that the door is provided with.

A mechanism as just described in the previous paragraph, ideally includes a damper 85 between section 2 and the opposite end of lever 81 to that which contacts magnetic piece 83. Damper 85 ensures that lever 81, once tilted by the opening action, remains tilted until door 60 is closed whereupon the action of the damper 85 lowers lever 81 gently onto magnetic piece 83 rather than allowing sudden noisy contact. This gives the mechanism an aesthetically pleasing feel. Similarly, other dampers may be used between door 60 and section 2, to prevent door 60 and section 2 from colliding noisily due to the tension in spring 84 as the catch releases.

Figure 35:
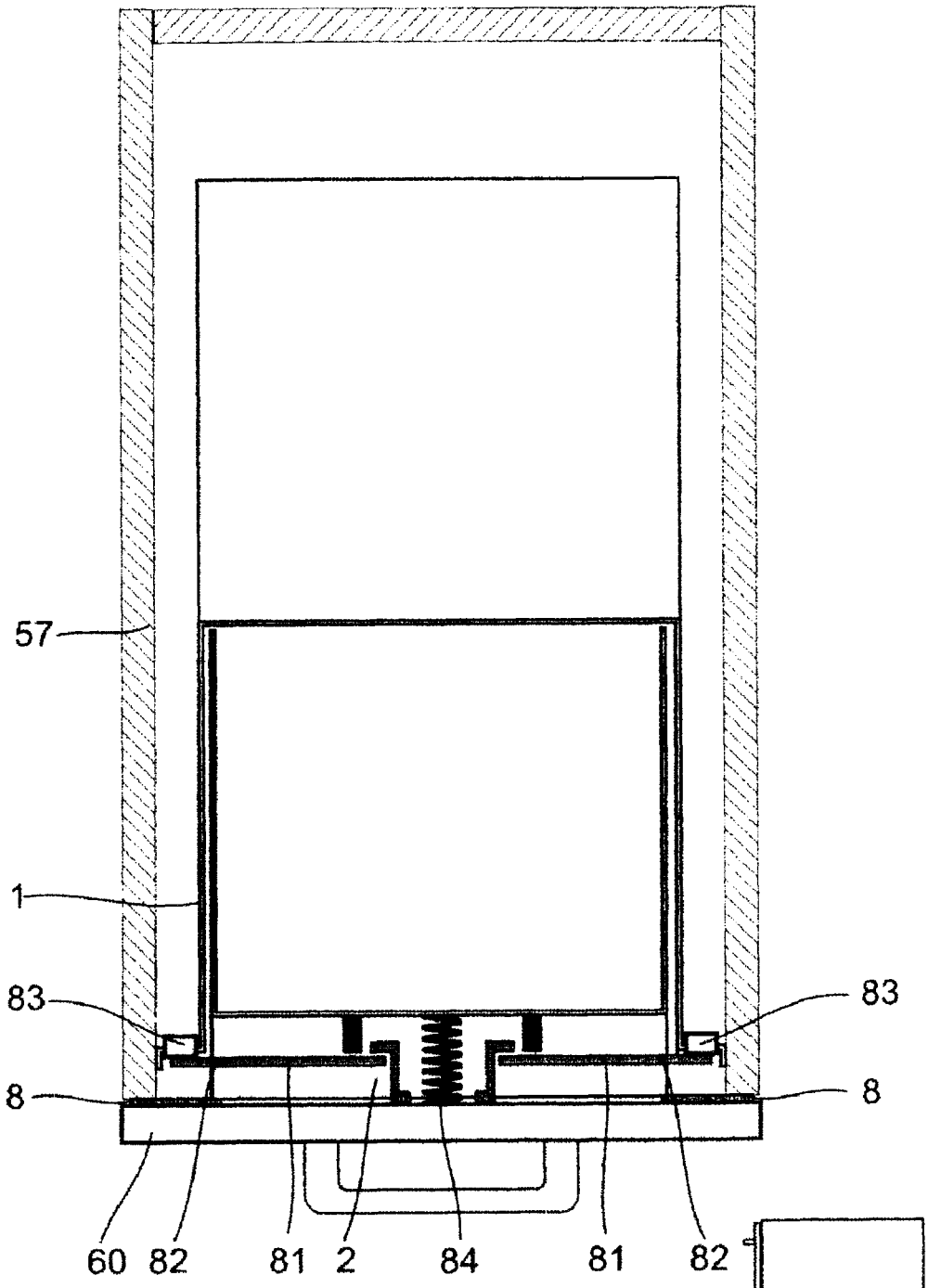
FIG. 35 is a view from above of the bin of FIG. 1, mounted within a cupboard, and fitted with an alternative closure mechanism; the door here is closed and the closure mechanism is in the closed resting state.
Figure 36:
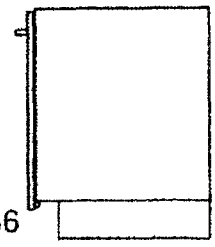
FIG. 36 is a side view showing the relative positions of the door and cupboard in FIG. 35.

The following Figures illustrate the operation of such a mechanism during the opening and closing sequence, showing the interaction between the various components at each stage. The configuration of the bin used, comprising sections 1 and 2, mounted within cupboard 57, with a symmetrical pair of levers 81 and magnetic pieces 83. FIGS. 35, 37, 39 and 41 are views from above and FIGS. 36, 38, 40 and 42 are corresponding scaled down views from the side to clarify the position of the door at each stage;

FIG. 35 is a view of the bin in the closed position from above; door 60 is held at rest against section 2 by spring 84. Levers 81 are magnetically bonded to magnetic pieces 83 and as a result are holding section 2 in place via the connection between levers 81 and section 2 through pivots 82. Door 60 is held against section 2 by spring 84.

Figures 37, 38:
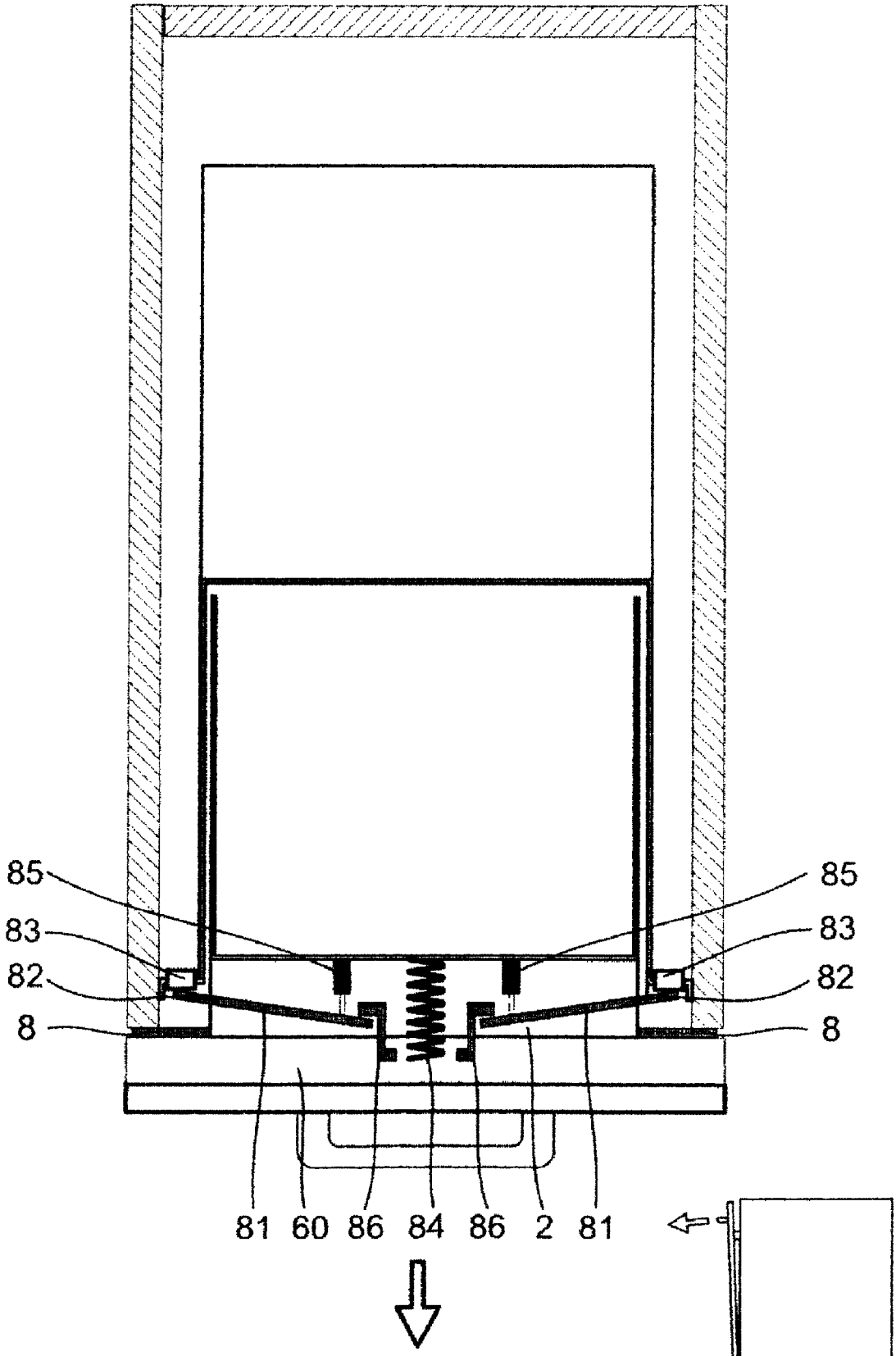
FIG. 37 is the same view as FIG. 35 but the door here is being pulled open and the catch is just about to release.
FIG. 38 is a side view showing the relative positions of the door and cupboard in FIG. 37.

FIG. 37 is a view from above of the bin of FIG. 35 with the door being pulled in the direction of the arrow; the mechanism is at the point when it is just about to release. Door 60 has rotated away from section 2 about hinge 8 and is transmitting the force onto section 2 via spring 84. 'Z' sections 86, attached to the back of door 60 are pulling the ends of levers 81 thus prising them away from magnetic pieces 83 as they rotate about pivots 82. The pistons in dampers 85 have extended to remain resting against levers 81.

Figures 39, 40:
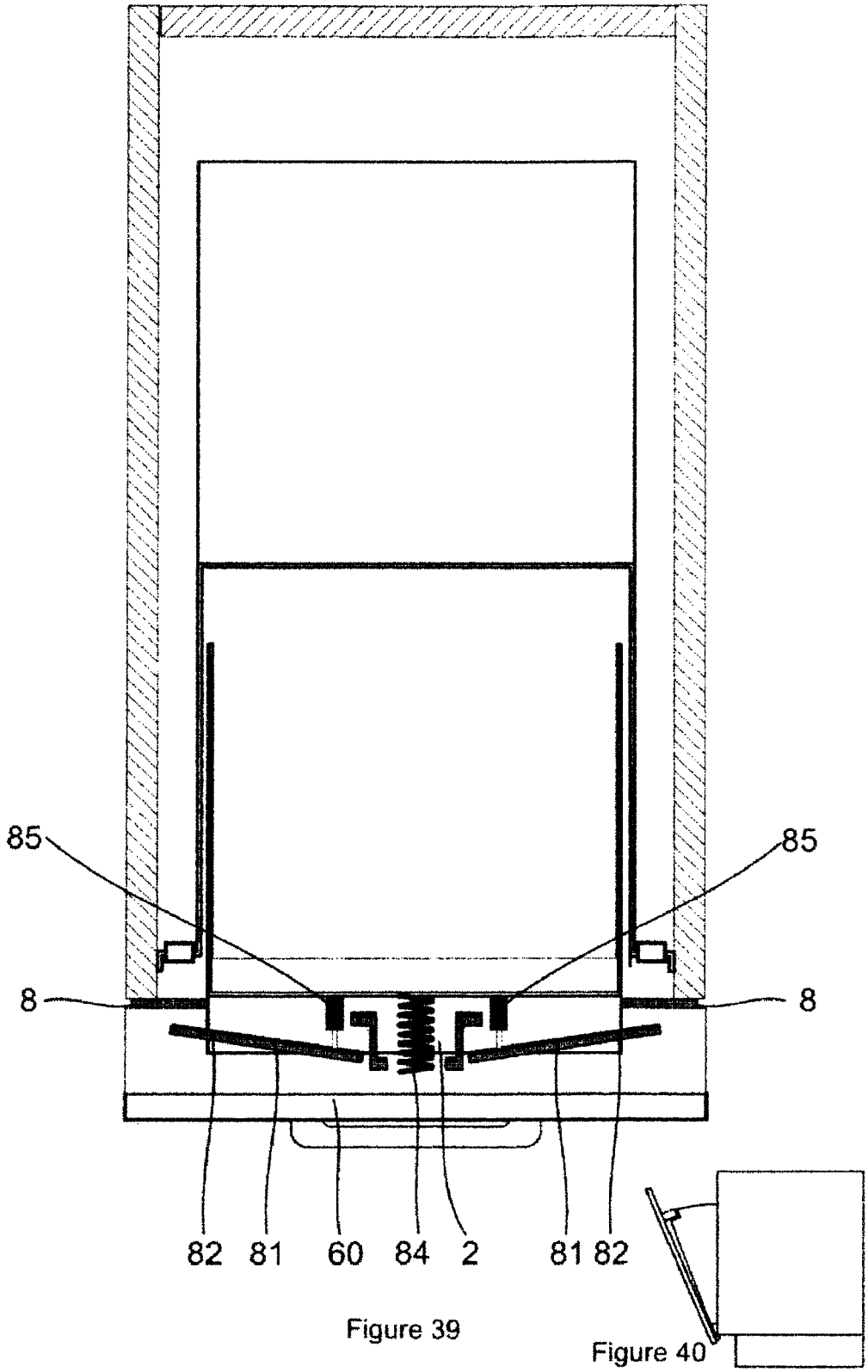
FIG. 39 is the same view as FIG. 35 but the door here has been opened and the closure mechanism is in the open resting state.
FIG. 40 is a side view showing the relative positions of the door and cupboard in FIG. 39.

FIG. 39 follows on from FIG. 37 just after the catch has released. The mechanism is in the open resting state; section 2 and the door are resting against each other under the tension of spring 84 and levers 81 are tilted on pivots 82 and held in place by dampers 85. The whole door assembly may be rotated like this about hinge 8.

Figure 41:
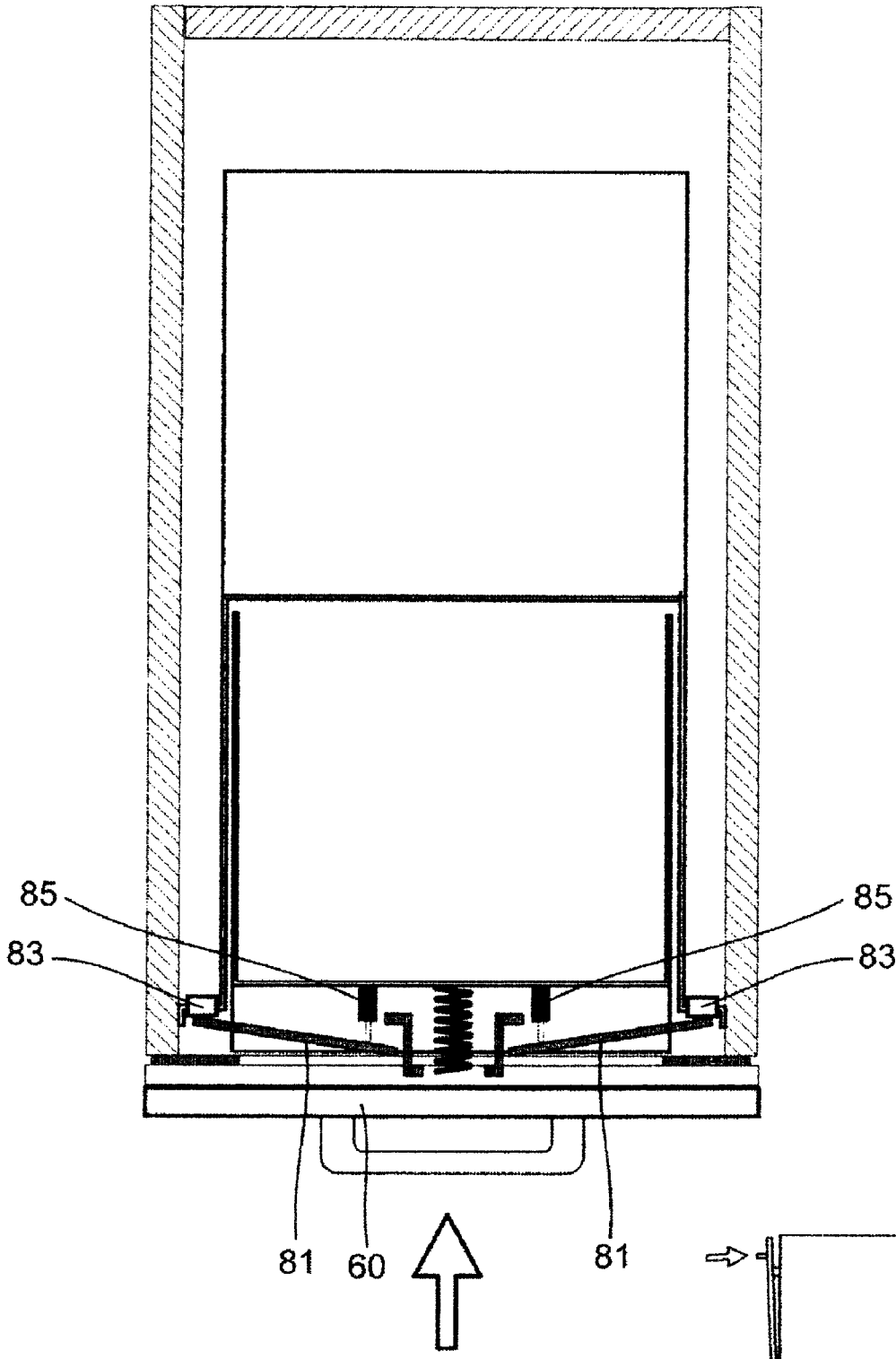
FIG. 41 is the same view as FIG. 35 but the door here is being pushed closed and the closure mechanism is just about to engage.
Figure 42:
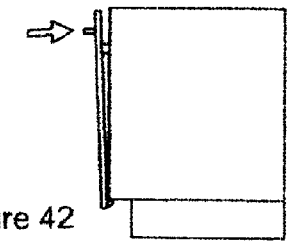
FIG. 42 is a side view showing the relative positions of the door and cupboard in FIG. 41.

FIG. 41 is the bin as shown in FIG. 39 but now being pushed closed in the direction shown by the arrow. The ends of levers 81 have just made contact with magnetic pieces 83 and the dampers 85 are just starting to slowly retract thus allowing the levers 81 to make full contact with magnetic pieces 83 again.

With this alternative design, the invention provides a mechanism by which the bin may be opened and closed in a way that is both robust in terms of contamination, the contact faces being flat, and also does not have any visual effect upon the exterior of the cupboard door.

A second alternative design for a mechanism to maintain the second section 2 closed with respect to the first section 1, comprises a sprung latch arrangement of the type, commonly used on doors for buildings. The sprung latch and release handle are connected to the second section 2 and the mating latch plate or orifice, to receive the latch bolt, is connected to, or integrated within, the first section 1. While providing the required basic function, this design is not preferred as it lacks robustness: with respect to contamination as spilt materials may jam the mechanism; with respect to the use of excessive force as elements may distort permanently as they allow the mechanism to release. This design also requires a device such as a handle or button, by which the catch may be released and as such, creates the complication of having to match means of release to each style of door.

The invention is not intended to be restricted to the details of the above-described embodiment. For instance, the bin can be sized to fit within any cupboard.

I claim:

1. A compactor comprising:

a bin comprising:

a first section including:

a base;

two side walls extending upwards from opposite sides of the base;

a rear wall connecting the side walls and sloping forwards; and a second section comprising:

two side walls sized to fit within and adjacent to the side walls of the first section;

a front wall connecting the side walls;

a hinge connecting the bottom of the front wall, to the base of the first section;

wherein the rear wall of the first section slopes forwards, towards the front wall of the second section, such that a contents placed between the first section and the second section are compacted between the front wall and the rear wall, as the second section rotates about the hinge towards the first section, the slope on the rear wall directing the contents downward; and a cupboard, the bin mounted within the cupboard, the bin being accessible within the cupboard by a door of the cupboard.

2. A compactor as claimed in claim 1, wherein the rear wall of the first section has a demountable connection to the side walls that allows the rear wall to be removed quickly, without the use of tools, comprising:

walls extending inwards from the rear edges of the side walls of the first section, and configured with a plurality of apertures;

a series of hooked protrusions extending back from the rear wall of the first section, that engage with the above mentioned apertures.

3. A compactor as claimed in claim 1, further comprising a drip tray resting upon the base of the first section.

4. A compactor as claimed in claim 1, further comprising liner holders connected to the top edges of the front and rear walls and configured as a series of sections mounted in line such that the user may either fit one liner through all the holders simultaneously, or fit a series of adjacent liners to the individual holders.

5. A compactor as claimed in claim 1, further comprising a reusable liner specifically for use in conjunction with an inner biodegradable liner, and comprising:

a bag made from a robust, washable, flexible material such as fabric, proportioned to fit outside of and support all round, an inner biodegradable liner, with;

a strap or flap situated towards the top of the liner at the front, by which it may be attached to the front wall of the second section;

an opposite strap loop attached to the rear of the liner mouth and proportioned to connect to the rear wall with enough slack to allow the second section to open to the same degree as is allowed by any other liners that are fitted alongside;

magnetic elements attached around the mouth of the liner and a magnetic holder plate, or plurality thereof, comprising:

an upright flat section which by using magnetic force, grips the inner biodegradable liner between itself and the magnetic elements;

an upper part extending outwards from the top of the upright flat section of the magnetic holder plate, over the top edges of the reusable and inner biodegradable liners and down on the outside of the reusable liner, thus preventing material from falling between the upper edges of the reusable and inner biodegradable liners.

6. A compactor as claimed in claim 1, further comprising a safety device, to prevent the second section from falling fully open, comprising:

a protrusion extending from one of the side walls of the first section, towards the opposite side wall;

a tab protruding from one of the side walls of the second section positioned and proportioned such that when the second section is opened to a point slightly beyond that which is required to tension a reusable liner of the bin, the tab and protrusion engage to prevent the second section from opening further.

7. A compactor as claimed in claim 1, further comprising a closure mechanism, which could be used singularly or as a plurality thereof, comprising:

a first magnetic element connected to the first section, upright and positioned towards the front;

a second magnetic element connected to the second section such that when the bin is closed, a mating face of the second magnetic element lies in the same plane as an outer face of the first magnetic element, the connection also allowing the second magnetic element to move within this plane, with one point of the travel aligning both magnetic elements such that they form a magnetic bond.

8. A compactor as claimed in claim 1 wherein the front wall of the second section of the bin is attached to the door of the cupboard.

9. A compactor as claimed in claim 1 wherein the base of the first section of the bin is integrally formed with a base of the cupboard.

10. A compactor as claimed in claim 1 wherein the two side walls of the first section of the bin are integrally formed with two side walls of the cupboard.

11. A compactor as claimed in claim 1 wherein the cupboard further comprises:

a sliding mechanism connecting the door of the rigid enclosure cupboard to the second section and allowing one degree of freedom preferably in a vertical direction in relation to the door being in a closed position;

a catch mechanism comprising:

a first magnetic element connected to and parallel to, an inner face of the door;

a second magnetic element connected to an inner side or top wall of the cupboard, and positioned such that when the door is closed, a mating face of the first magnetic element and a mating face of the second magnetic element align sufficiently to form a magnetic bond; and a spring connected between the door and the second section, to support the door against the force of gravity when at rest.

12. A compactor as claimed in claim 11, further comprising a protrusion extending from the lower part of the door of the cupboard which serves as a pedal by which the sliding closure mechanism may be operated.

13. A compactor as claimed in claim 1, wherein the bin further comprises a closure mechanism comprising:

a magnetic lever mounted upon a pivot connected to the front wall of the second section;

a magnetic element mounted at the front of the first section, positioned such that when the front wall of the second section is in the upright position, the magnetic lever and magnetic element make contact and bond magnetically.

* * * * *